US011828012B2

(12) United States Patent
Strahl et al.

(10) Patent No.: US 11,828,012 B2
(45) **Date of Patent: *Nov. 28, 2023**

(54) ACCESSORY FOR SEWING MACHINE AND METHODS OF USING THE SAME

(71) Applicant: Singer Sourcing Limited LLC, Lavergne, TN (US)

(72) Inventors: Maria Strahl, Jönköping (SE); Matylda Florén, Huskvarna (SE); Petter Madlycke, Huskvarna (SE); Roberth Eriksson, Jönköping (SE); Stina Petersson, Jönköping (SE)

(73) Assignee: Singer Sourcing Limited LLC, Lavergne, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/079,502

(22) Filed: Dec. 12, 2022

(65) Prior Publication Data

US 2023/0106887 A1 Apr. 6, 2023

Related U.S. Application Data

(63) Continuation of application No. 16/717,771, filed on Dec. 17, 2019, now Pat. No. 11,525,199.

(51) Int. Cl.

| | |
|---|---|
| ***D05C 7/08*** | (2006.01) |
| ***D05B 33/00*** | (2006.01) |
| ***D05C 9/04*** | (2006.01) |
| ***D05C 3/02*** | (2006.01) |

(52) U.S. Cl.

CPC ..... *D05C 7/08* (2013.01); *D05B 33/00* (2013.01); *D05C 3/02* (2013.01); *D05C 9/04* (2013.01)

(58) Field of Classification Search

CPC . D05C 7/08; D05C 11/18; D05C 9/04; D05B 35/06; D05B 57/14; D05B 57/143; D05B 33/00

USPC ..... 112/103

See application file for complete search history.

(56) References Cited

U.S. PATENT DOCUMENTS

| | | | | |
|---|---|---|---|---|
| 2,725,837 | A | 12/1955 | Seaman | |
| 4,640,208 | A * | 2/1987 | Glenn | D05C 7/08 112/475.08 |
| 6,745,712 | B1 | 6/2004 | Fujinaga | |
| 6,957,615 | B1 | 10/2005 | Landoni | |
| 8,671,861 | B2 | 3/2014 | Konig | |
| 9,303,346 | B2 | 4/2016 | Kobayashi | |

(Continued)

FOREIGN PATENT DOCUMENTS

| | | |
|---|---|---|
| CN | 1432316 | 7/2003 |
| CN | 1223714 | 10/2005 |

(Continued)

*Primary Examiner* — Nathan E Durham

(74) *Attorney, Agent, or Firm* — Calfee, Halter & Griswold

(57) ABSTRACT

An exemplary embroidery accessory for a sewing machine includes a spool that is rotatable around a first vertical axis, a support rotatably attached to the sewing machine and to the spool, a sewing guide, and a mechanism for rotating the support around a second vertical axis of rotation. The spool receives and dispenses a length of embroidery material and is supported above a sewing bed of the sewing machine by the support. The sewing guide has a needle opening configured to receive a needle of the sewing machine and to guide the embroidery material toward the needle.

22 Claims, 20 Drawing Sheets

(56) References Cited

U.S. PATENT DOCUMENTS

| | | | | |
|---|---|---|---|---|
| 9,631,306 | B2 | 4/2017 | Shomura | |
| 9,631,307 | B2 | 4/2017 | Shomura | |
| 9,834,878 | B2 | 12/2017 | Egami | |
| 9,863,074 | B2 | 1/2018 | Nakajima | |
| 11,525,199 | B2 | 12/2022 | Strahl | |
| 2006/0224271 | A1* | 10/2006 | Yoshimura | D05B 21/00 700/133 |
| 2008/0264316 | A1 | 10/2008 | Tajima | |
| 2015/0240401 | A1* | 8/2015 | Kobayashi | D05B 35/06 112/102.5 |

FOREIGN PATENT DOCUMENTS

| | | |
|---|---|---|
| CN | 202450256 | 9/2012 |
| CN | 202898763 | 4/2013 |
| CN | 202968976 | 6/2013 |
| CN | 204509677 | 7/2015 |
| CN | 106048914 | 10/2016 |
| CN | 107653580 | 2/2018 |
| DE | 19960904 | 6/2003 |
| IN | 205099902 | 3/2016 |
| JP | H 10212655 A | 8/1998 |
| KR | 102016065662 | 6/2016 |
| TW | M543886 | 6/2017 |

* cited by examiner

ACCESSORY FOR SEWING MACHINE AND METHODS OF USING THE SAME

CROSS-REFERENCE TO RELATED APPLICATIONS

This application is a continuation of U.S. patent application Ser. No. 16/717,771, filed Dec. 17, 2019, and entitled ACCESSORY FOR SEWING MACHINE AND METHODS OF USING THE SAME, now U.S. Pat. No. 11,525,199, the entire disclosures of which are hereby incorporated herein by reference in its entirety.

TECHNICAL FIELD

The present invention relates generally to sewing machines, and in particular to accessories thereof.

BACKGROUND OF THE INVENTION

Sewing machines can sew an embroidery pattern on a workpiece that is mounted in an embroidery frame. The embroidery frame is moved relative to the sewing head to sew an embroidery pattern onto the cloth workpiece using a needle and thread.

These sewing machines can include an optional spool of material—such as ribbon or cord—that is dispensed ahead of the needle as the needle follows the embroidery pattern so that the stitching attaches the ribbon or cord to the cloth workpiece.

SUMMARY

Exemplary embodiments of sewing machine accessories, sewing machines for performing embroidery, and methods of using the same are disclosed herein.

An exemplary embroidery accessory for a sewing machine includes a spool that is rotatable around a first vertical axis, a support rotatably attached to the sewing machine and to the spool, a sewing guide, and a mechanism for rotating the support around a second vertical axis of rotation. The spool receives and dispenses a length of embroidery material and is supported above a sewing bed of the sewing machine by the support. The sewing guide has a needle opening configured to receive a needle of the sewing machine and to guide the embroidery material toward the needle.

An exemplary sewing machine includes a bed, an embroidery frame for holding a workpiece, an actuator that movably attaches the embroidery frame to the bed, and an arm disposed above the bed, and an accessory for dispensing the length of embroidery material to be sewn to the workpiece. The arm is arranged above the bed and a bottom surface of the arm is spaced apart from a top surface of the bed by an arm height. The accessory includes a spool that receives and dispenses the length of embroidery material, a support that supports the spool above the bed of the sewing machine, and a sewing guide. The guide has a needle opening for receiving a needle of the sewing machine. The support is rotatably attached to the arm and to the spool, the spool being rotatable around a first vertical axis of rotation. A mechanism rotates the support around a second axis of rotation that is colinear with the first axis of rotation.

An exemplary method of operating an accessory for a sewing machine to attach a length of embroidery material to a workpiece includes the steps of: providing the sewing machine and accessory, moving the workpiece so that the needle of the sewing machine follows a predetermined sewing path, operating a mechanism of the accessory to rotate the support clockwise or counterclockwise so that the embroidery material opening leads the needle along the predetermined sewing path, dispensing at least a portion of the length of embroidery through the embroidery material opening of the guide, and sewing at least a portion of the length of the embroidery material to the workpiece with the needle. The accessory includes a spool that is rotatable around a first vertical axis, a support rotatably attached to the sewing machine and to the spool, a sewing guide, and a mechanism for rotating the support clockwise and counterclockwise around a second vertical axis of rotation. The spool receives and dispenses a length of embroidery material and is supported above a sewing bed of the sewing machine by the support so that the spool and the support rotate independently around the first vertical axis of rotation. The sewing guide has a needle opening configured to receive a needle of the sewing machine and to guide the embroidery material toward the needle.

A further understanding of the nature and advantages of the present invention are set forth in the following description and claims, particularly when considered in conjunction with the accompanying drawings in which like parts bear like reference numerals.

BRIEF DESCRIPTION OF THE DRAWINGS

To further clarify various aspects of embodiments of the present disclosure, a more particular description of the certain embodiments will be made by reference to various aspects of the appended drawings. It is appreciated that these drawings depict only typical embodiments of the present disclosure and are therefore not to be considered limiting of the scope of the disclosure. Moreover, while the figures can be drawn to scale for some embodiments, the figures are not necessarily drawn to scale for all embodiments. Embodiments and other features and advantages of the present disclosure will be described and explained with additional specificity and detail through the use of the accompanying drawings in which.

DETAILED DESCRIPTION

The following description refers to the accompanying drawings, which illustrate specific embodiments of the present disclosure. Other embodiments having different structures and operation do not depart from the scope of the present disclosure.

Exemplary embodiments of the present disclosure are directed to sewing machines for sewing embroidery patterns and accessories for use with the same. It should be noted that various embodiments of sewing machines and accessories are disclosed herein, and any combination of these options can be made unless specifically excluded. In other words, individual components or portions of the disclosed devices can be combined unless mutually exclusive or otherwise physically impossible.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

Figure 1:
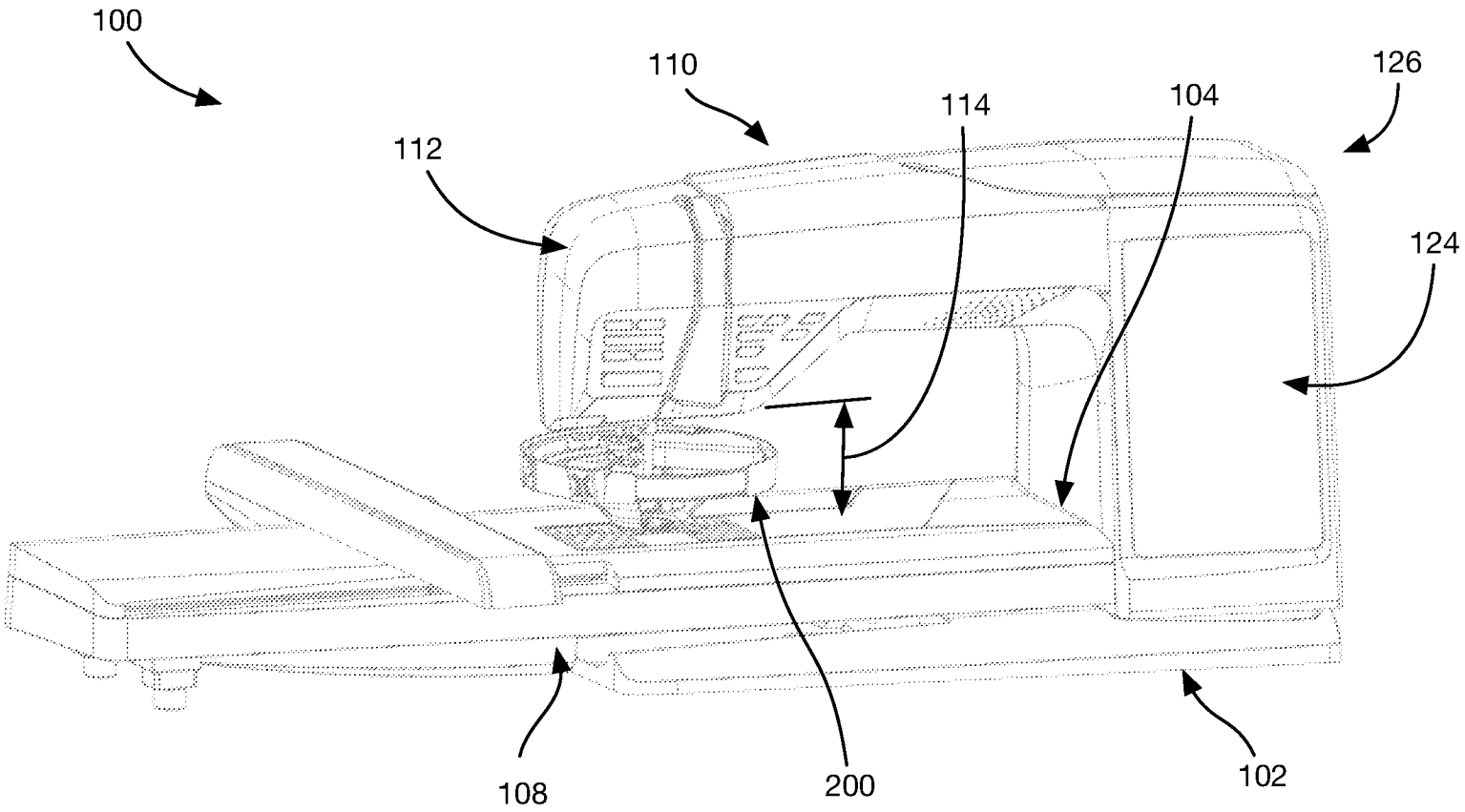
FIG. 1 is a perspective rendering of exemplary embodiments of an accessory and a sewing machine.
Figure 2:
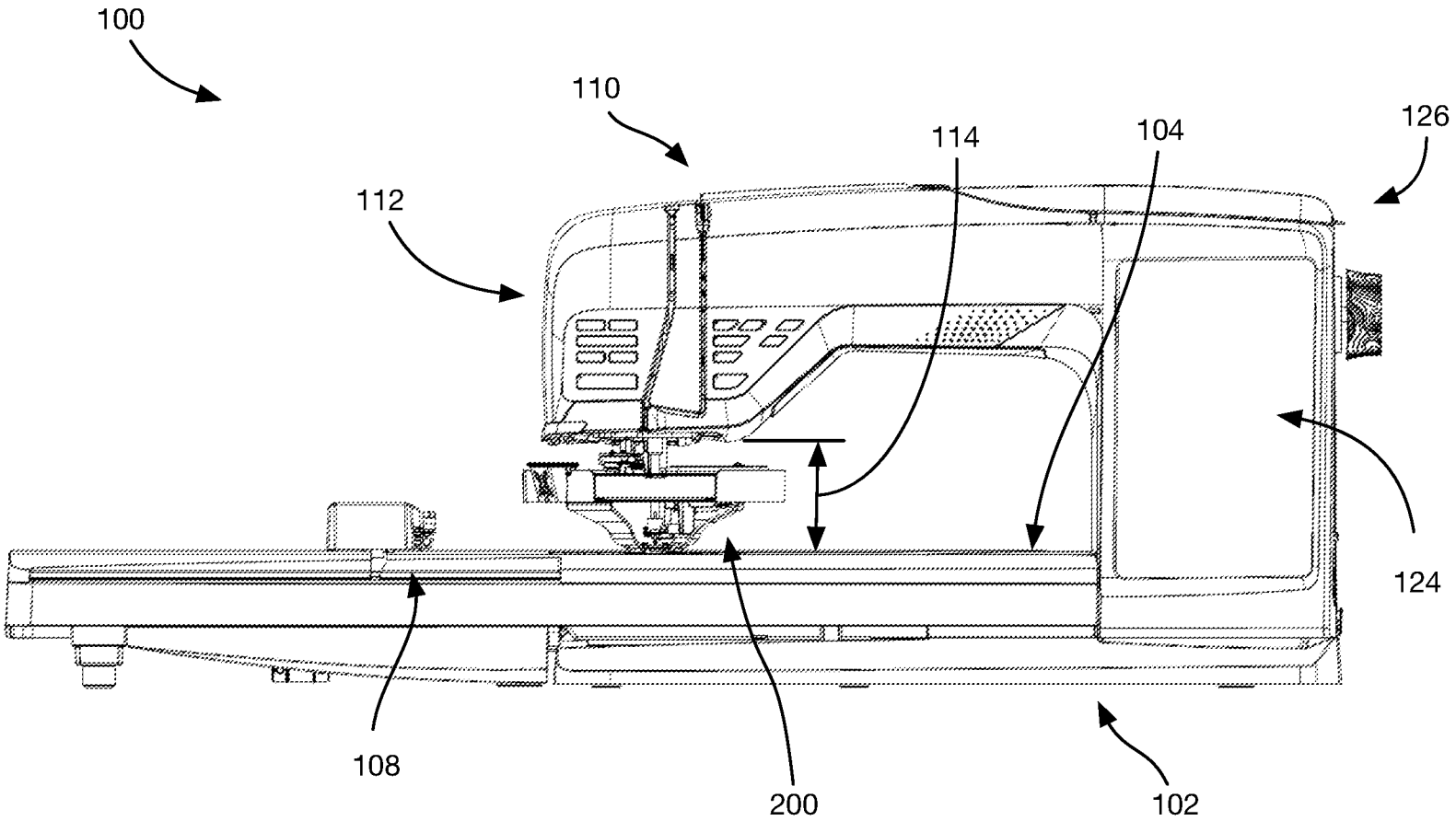
FIG. 2 is a front view rendering of the embodiments of FIG. 1.
Figure 3:
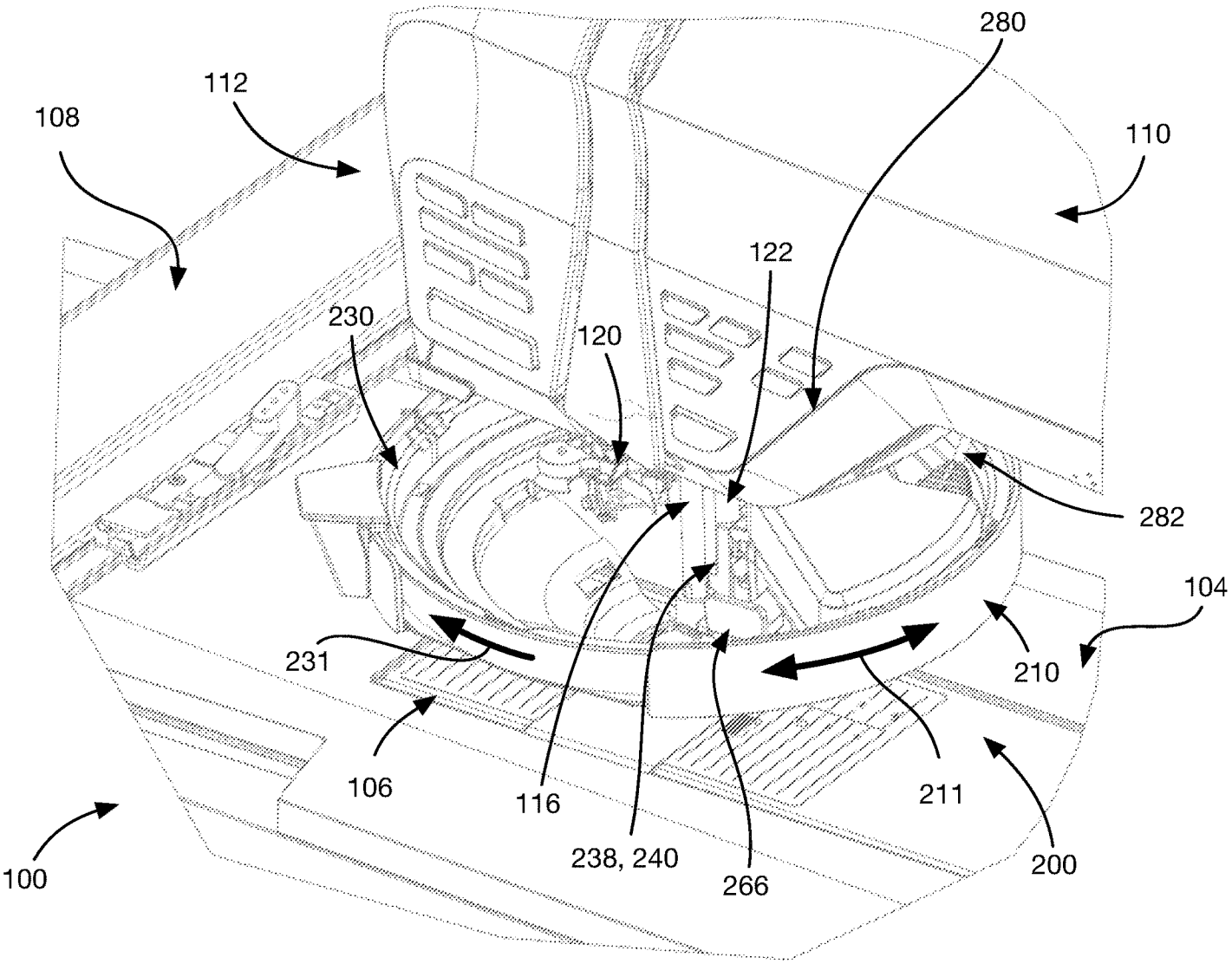
FIG. 3 is a close-up perspective view rendering of the embodiments of FIG. 1.
Figure 4:
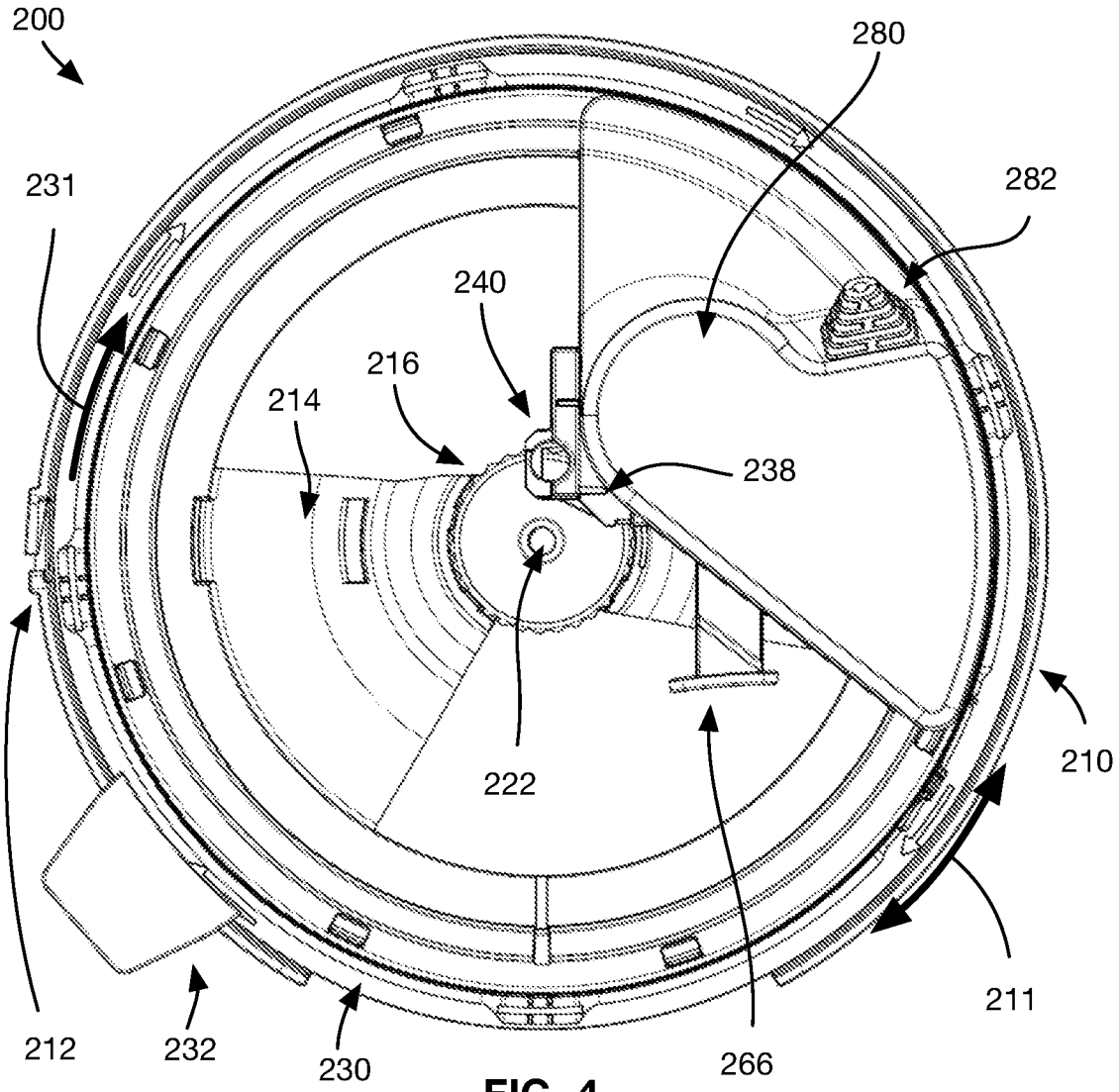
FIG. 4 is a top view rendering of the accessory of FIG. 1.
Figure 5:
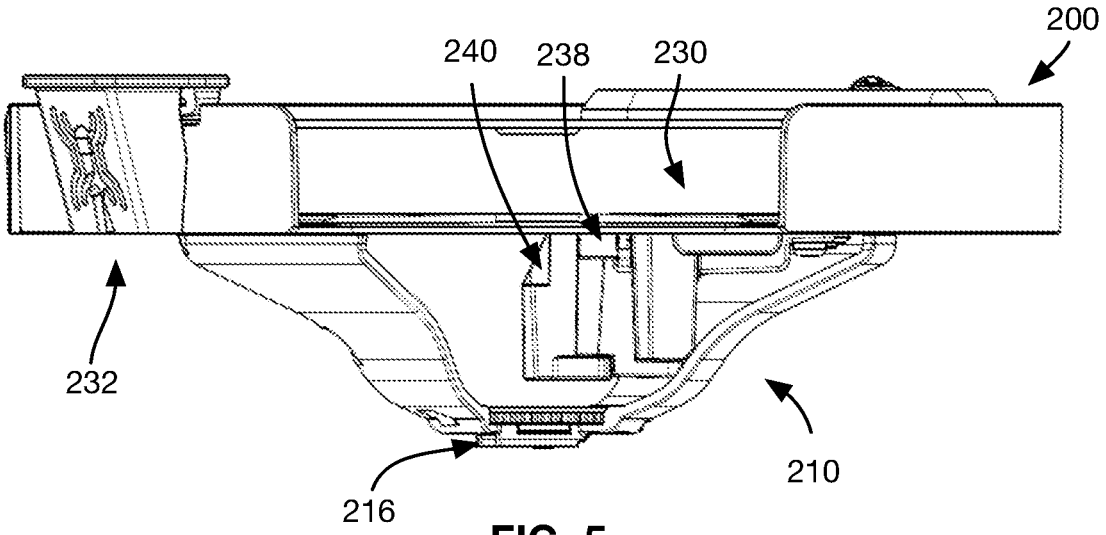
FIG. 5 is a front view rendering of the accessory of FIG. 1.

Referring now to FIGS. 1-3, an exemplary accessory 200 is shown attached to an exemplary sewing machine 100. The sewing machine 100 includes a base 102, a sewing bed 104, and an arm 110 extending horizontally above the base 102 and sewing bed 104. A touch screen and display 124 are provided on a tower 126 that supports the arm 110 above the base 102. The touch screen 124 provides an interface to a computer (not shown) that controls the sewing machine 100 and attached accessory 200 to create embroidery patterns on a cloth workpiece (not shown). During operation the cloth workpiece is attached to an embroidery frame (not shown) that is attached to an embroidery frame mount 108. The embroidery frame mount 108 is attached to the sewing machine base 102 by at least one actuator that can move the embroidery frame mount 108 from left-to-right and back-to-front to provide two-axis control of the position of the embroidery frame.

A sewing head 112 of the machine is provided at a distal end of the arm 110. The sewing head 112 is spaced apart from the sewing bed 104 by a minimum arm height 114. A needle bar 116 (FIG. 3) holding a needle (not shown) extends downward from the sewing head 112 toward a needle plate 106 in the sewing bed 104. Thread is provided to the needle from spools (not shown) supported by the arm 110 and a bobbin (not shown) below the needle plate 106 so that stitches can be formed in the workpiece.

Referring now to FIG. 3, the accessory 200 includes an attachment portion 238 that engages an attachment holder 240 to attach the accessory 200 to the sewing machine 100. The accessory 200 fits within the minimum arm height 114, which can range from about 3 inches to about 6 inches. The accessory 200 provides sufficient room around the needle bar 116 and needle so that normal sewing functions of the sewing machine 100 are not disrupted by the accessory 200. For example, sufficient space is provided for a needle threader 120 to thread the needle attached to the needle bar 116 without removing the accessory 200.

The attachment holder 240 attaches to an accessory mount 122 that extends below the sewing head 112. In some embodiments the accessory mount 122 is a presser bar typically used for a presser foot (not shown) of the sewing machine with the presser foot removed and replaced with the attachment holder 240 to provide a mounting point for the accessory 200. The accessory mount 122 is received in an opening 244 of the attachment holder 240 and can be secured in the opening 244 by, for example, a set screw or other suitable attachment means. An attachment release 266 can be depressed to disengage the attachment portion 238 from the attachment holder 240 so that the accessory 200 can be attached to or removed from the sewing machine 100. The interaction of the attachment portion and holder 238, 240 is shown in FIGS. 20-34 and described in greater detail below.

Referring now to FIGS. 3-8, the accessory 200 includes a spool 230 for receiving and dispensing a length of embroidery material 202 (FIGS. 9-13), such as, for example, ribbon, cord, strings of beads or sequins, or the like. The spool 230 is supported by a support 210 such that the spool 230 is rotatable about a first axis of rotation 204. The spool 230 and accessory 200 can hold and dispense a wide variety of embroidery materials, such as, for example, ribbon, cord, strings of beads, or strings of sequins. The spool 230 can have any suitable inner diameter for holding embroidery material. In the illustrated embodiment, the spool 230 has an inner diameter of at least 6.5 inches and can hold more than 20 feet of embroidery material. Loading the spool with embroidery material can take place while the spool 230 is attached to the support 210 or may be done while the spool 230 is removed from the support 210. Loading of the spool 230 and routing of the embroidery material through the accessory 200 is shown in FIGS. 9-13 and described in greater detail below.

The support 210 is rotatably attached to the attachment portion 238 and, as noted above, to the spool 230. The support 210 has a roughly conical shape extending from a wider top or first end to a narrower bottom or second end. The spool 230 rests in a circular channel in the support 210 near or at the top end of the conical shape. A spool retainer 232 for holding the spool 230 within the circular channel of the support 210 is provide at an outer diameter of the support 210. The spool retainer 232 is moved vertically to permit removal of the spool 230 from the channel for loading with embroidery material 202. The spool 230 can be retained within the channel in a wide variety of ways, such as with protrusions that allow the spool to snap into the channel while prohibiting the spool 230 from popping out of the open top of the channel. A cover can also be provided that attaches to the support 210 and covers the open channel so as to completely enclose the spool 230.

The support 210 includes a sewing guide 216 and a dispensing guide 212 for guiding the embroidery material 202 from the spool 230 along the dispensing path 236 and into the path of the needle 118 (FIGS. 18 and 19) for sewing to the workpiece. The sewing guide 216 has a needle opening 222 that receives the needle 118 of the sewing machine 100 and an embroidery material opening 218 (FIG. 16) for receiving the length of embroidery material from the spool 230. The sewing guide 216 includes an adjustment knob 224 that adjusts the positions of two guide members 228 to accommodate embroidery material with different widths. Alternatively, the sewing guide 216 can be removable from the support 210 so that other sewing guides with different sized embroidery material openings for different sized embroidery materials can be installed. The mechanism for adjusting the width of the path between the guide members 228 is shown in FIGS. 14-17 and is described in greater detail below.

Figure 6:
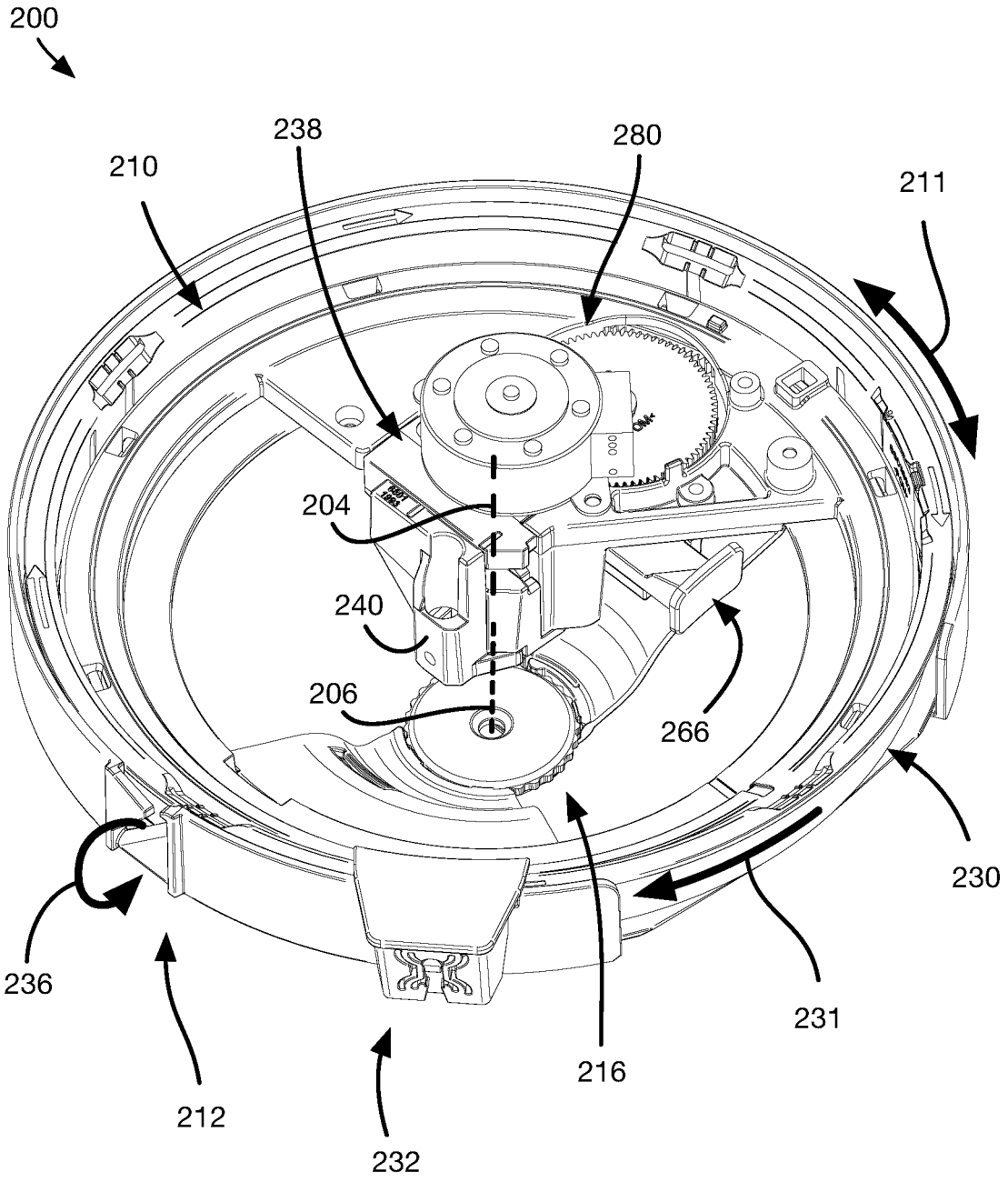
FIG. 6 is a top isometric view of an exemplary accessory for a sewing machine.
Figure 7:
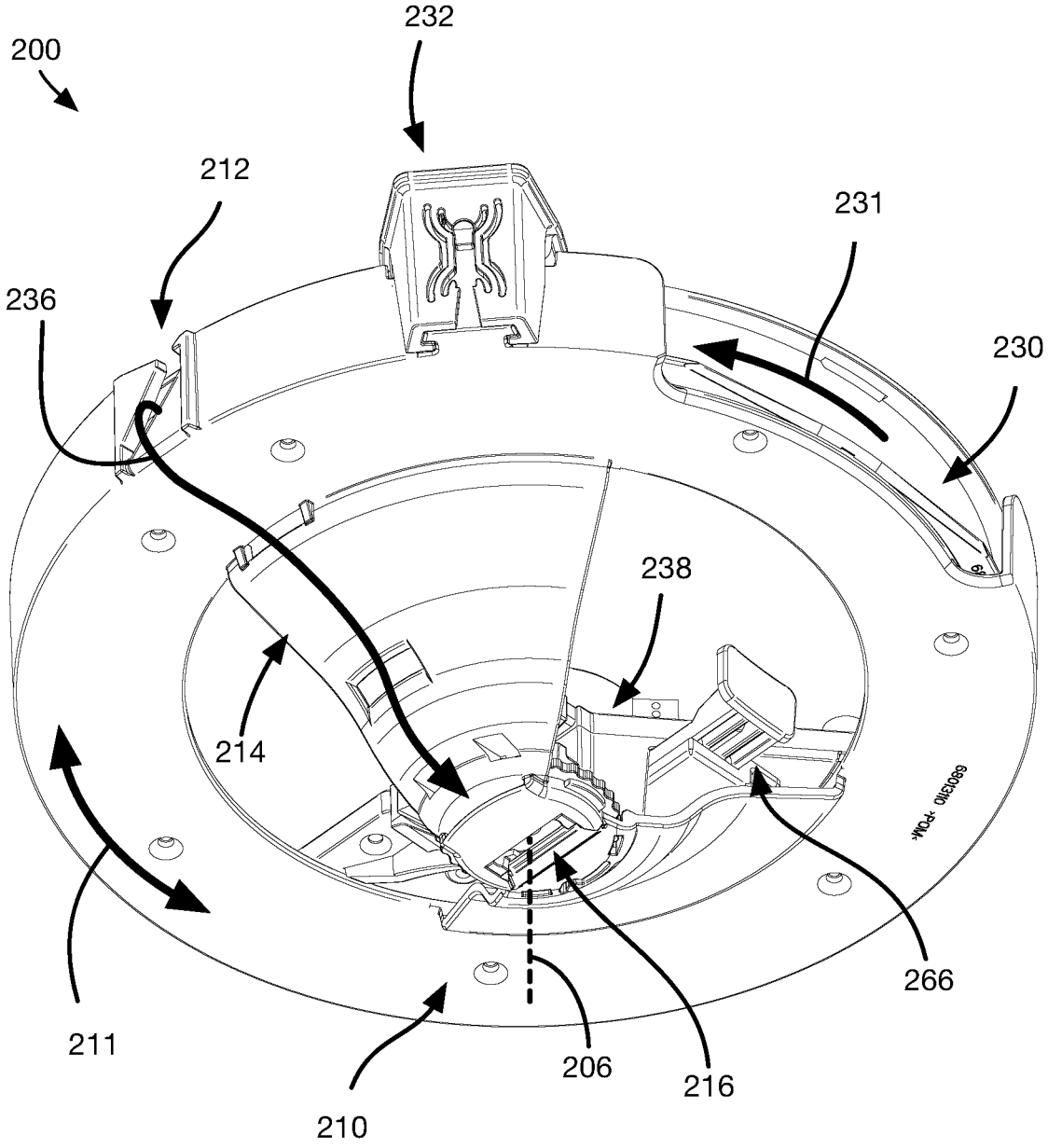
FIG. 7 is a bottom isometric view of an exemplary accessory for a sewing machine.
Figure 8:
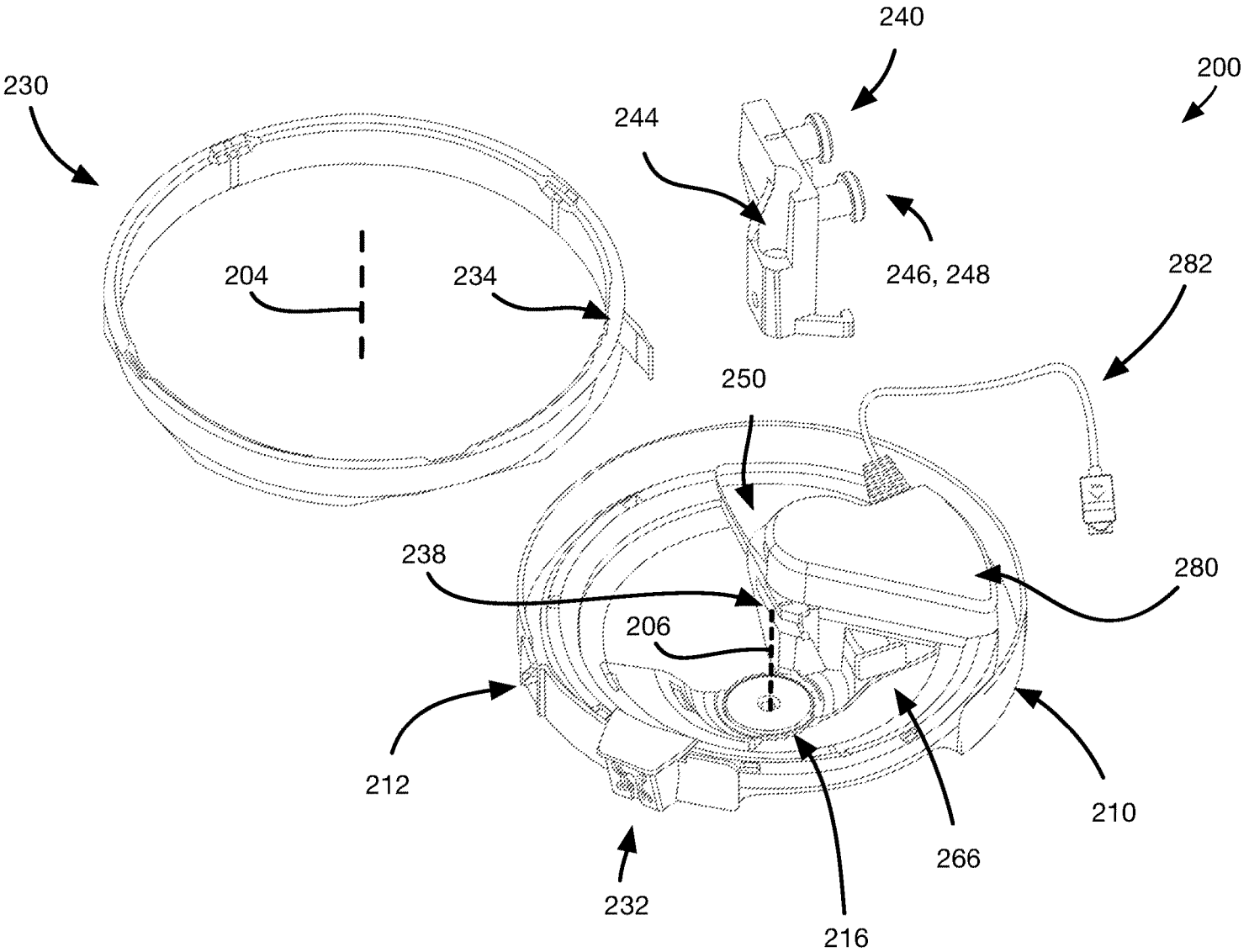
FIG. 8 shows an exploded view of an exemplary accessory for a sewing machine.

The dispensing guide 212 is positioned near the spool 230 and smoothly guides the length of embroidery material from the spool 230 to the embroidery material opening 218 in the sewing guide 216 along a dispensing path 236 (FIGS. 6 and 7). At least a portion of the embroidery material extends along the outer surface of the support 210 as the embroidery material is dispensed through the dispensing guide 212 and the sewing guide 216. A guide surface of the dispensing guide is arranged at about 45 degrees off of the axis of rotation of the spool 230. The angled guide surface twists the embroidery material as it is dispensed down the outer surface of the support 210 so that an outer surface of the embroidery material on the spool becomes a top surface of the embroidery material when the embroidery material is sewn onto a workpiece.

The support 210 can also include additional or auxiliary guides 214 (FIGS. 4 and 7) between the dispensing and sewing guides 212, 216 to support the embroidery material as it is dispensed from the spool 230 so that any slack in the embroidery material does not interfere with the workpiece.

A mechanism 280 rotates the support 210 relative to the stationary attachment portion 238 about a second axis of rotation 206 that is aligned with—i.e., parallel to—the first axis of rotation 204. The second axis of rotation 206 is colinear with a longitudinal axis of the needle bar 116 and needle 118 (FIGS. 18 and 19) of the sewing machine. In some embodiments, the first axis of rotation 206 is colinear with the second axis of rotation 204. The mechanism 280 can include a motor and a transmission and is capable of rotating the support 210 clockwise and counterclockwise. To save vertical space, the mechanism 280 is arranged in an interior of the support 210 and spool 230 so that at least a portion of the mechanism is arranged between a top surface and a bottom surface of the spool 230.

The transmission can include one or more gears, belts, or the like arranged to transfer rotational motion from the motor to the support 210. For example, the transmission can include a ring gear (FIGS. 6 and 18-19) attached to an inner diameter of a portion of the support 210.

The motor of the mechanism 280 receives power and control signals from the sewing machine via an electrical connection. The connection can be provided by a wire 282 that attaches between the accessory 200 and another portion of the sewing machine 100, such as the sewing arm 110. In some embodiments, power and data connections can be integrated into the attachment portion 238, attachment holder 240, and accessory mount 122 so that attaching the accessory 200 to the sewing machine 100 also provides an avenue for the transmission of power and control signals from the sewing machine 100 to the accessory 200.

Figure 10:
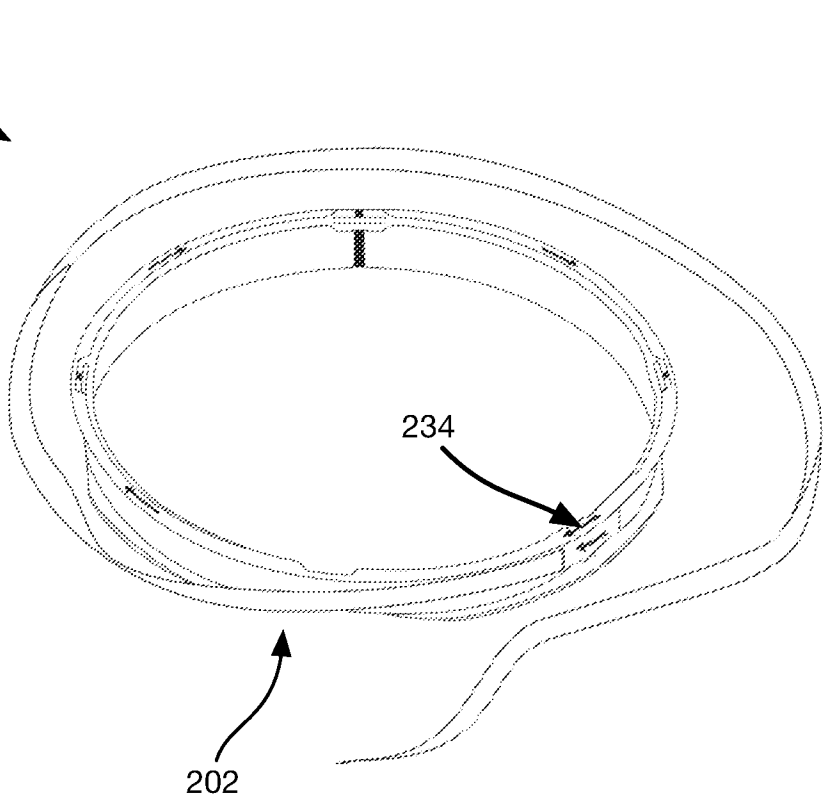
FIGS. 9 and 10 show the steps of winding ribbon on a spool for an exemplary accessory for a sewing machine.
Figure 9:
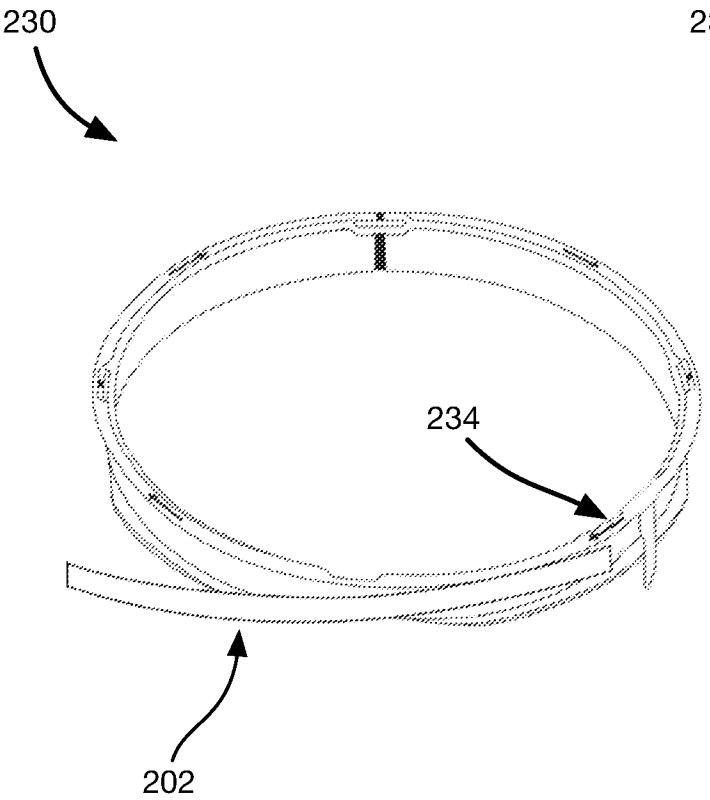

Referring now to FIGS. 9 and 10, the steps for loading embroidery material 202, such as the ribbon shown, onto the spool 230 are shown. First, an end of the embroidery material 202 is inserted into a retaining or ribbon clip 234 that is closed to firmly attach the embroidery material 202 to the spool 230. The embroidery material 202 is then wound around the spool 230. Once the spool 230 has been filled with material 202, the spool retainer 232 (e.g., FIG. 8) is raised, the spool 230 is inserted into the support 210, and the spool retainer 232 is lowered into the retaining position.

Figure 11:
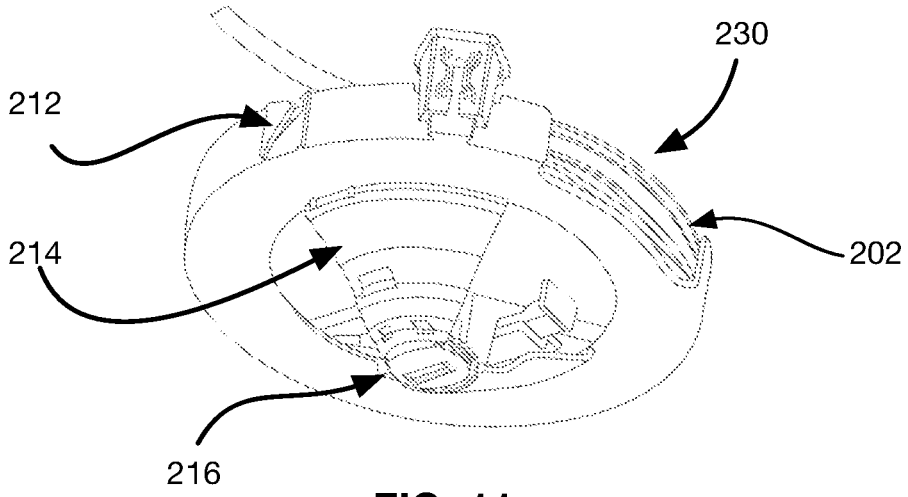
FIGS. 11-13 show the steps of threading ribbon through guides of an exemplary accessory for a sewing machine.
Figure 12:
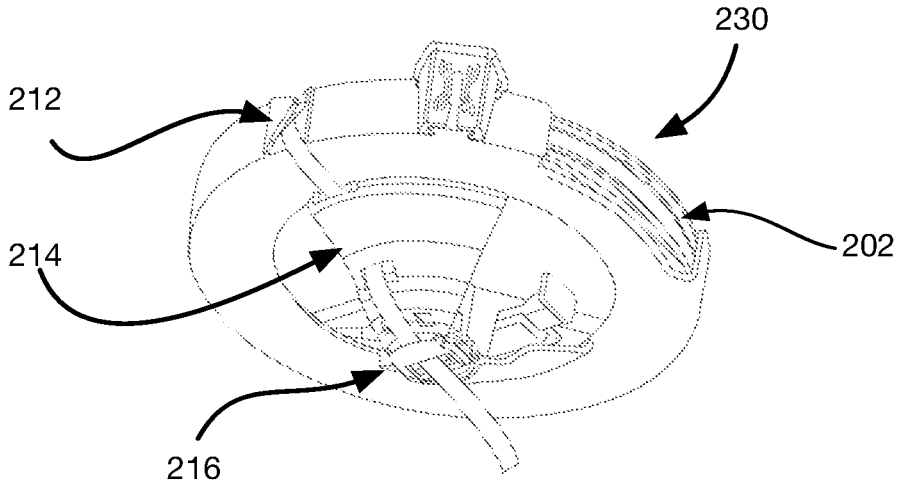
Figure 13:
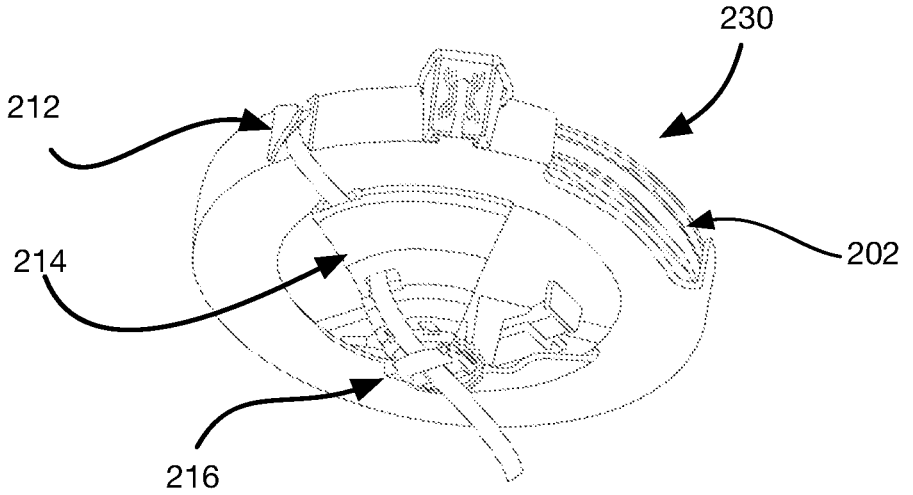
Figure 15:
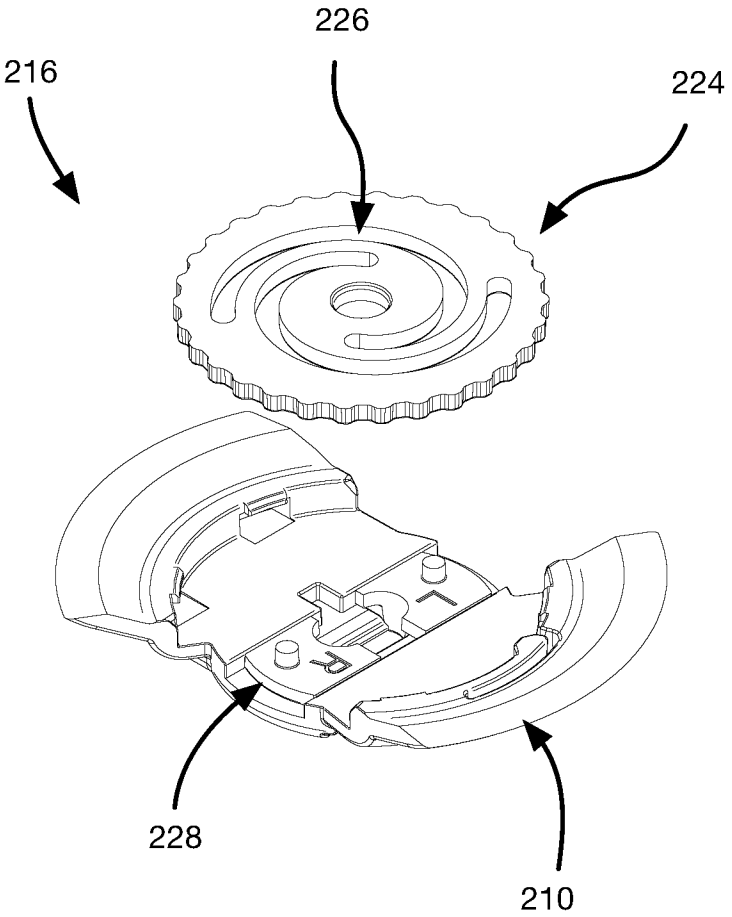
FIG. 15 shows a top isometric exploded view of the sewing guide of FIG. 15.
Figure 14:
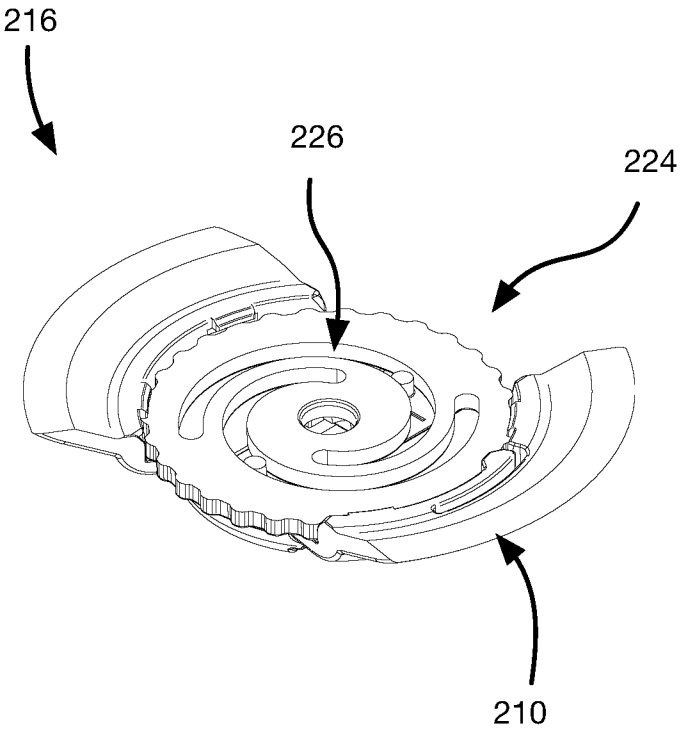
FIG. 14 shows an enlarged isometric view of a sewing guide for an exemplary accessory for a sewing machine with a portion of the adjusting knob cut away.
Figure 17:
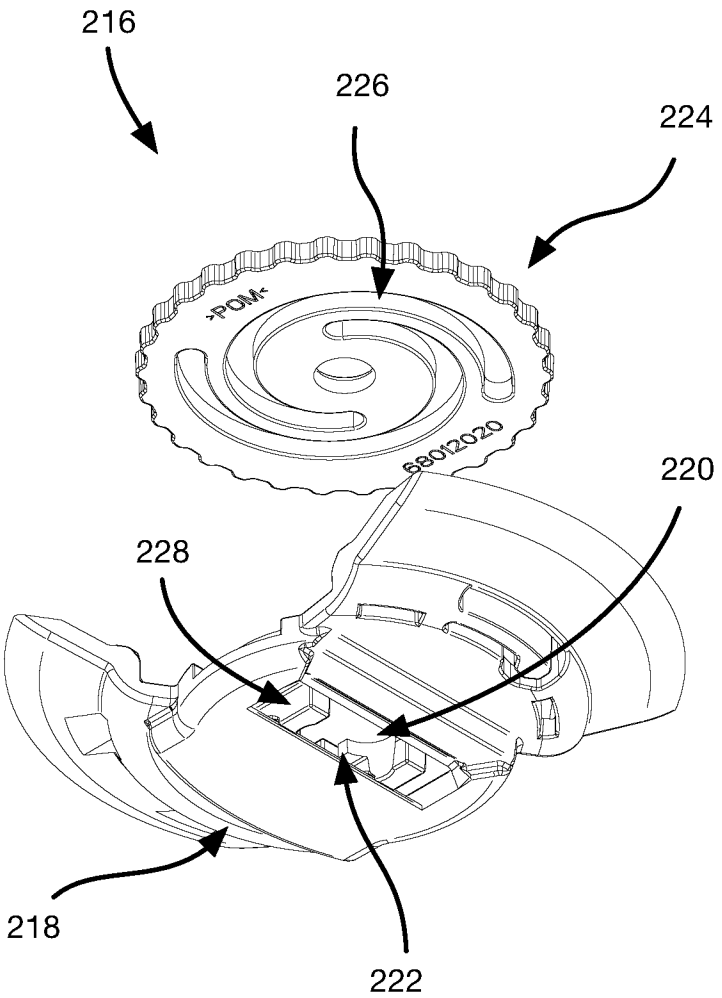
FIGS. 16-17 show bottom isometric exploded views of the sewing guide of FIG. 15.
Figure 16:
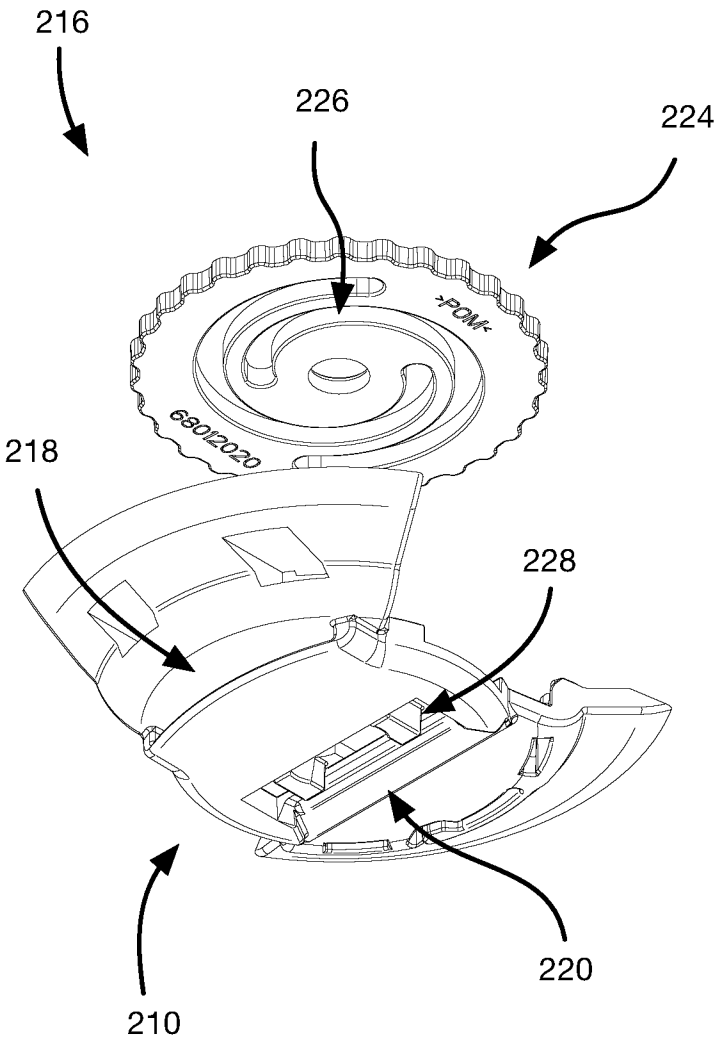

Once the full spool 230 has been installed in the accessory 200, the embroidery material 202 can be routed or threaded through the dispensing, auxiliary, and sewing guides 212, 214, 216 to prepare the accessory 200 for use, as is shown in FIGS. 11-13. The embroidery material 202 is first fed through the dispensing guide 212, then through any additional or auxiliary guides 214, and then through the sewing guide 216. In an embodiment with an adjustable sewing guide, the sewing guide 216 is also adjusted to match the width of the embroidery material 202.

Referring now to FIGS. 14-17, the mechanism for adjusting the width of the path between the ribbon guides or guide members 228 of the sewing guide 216 is shown. The sewing guide 216 includes an adjusting knob 224 that is shown in FIGS. 14-17 without a top portion to reveal guide grooves 226 that engage with protrusions extending from the guide members 228. The guide members 228 are inserted in a groove in the support 210 that extends transverse to the path of the embroidery material. The guide grooves 226 are spiral shaped so that rotating the adjusting knob 224 causes the protrusions of the guide members 228 to move the guide members 228 laterally within the transverse groove, thereby increasing or decreasing a distance between the guide members 228 to accommodate different sized embroidery material. Each of the guide members 228 includes a semi-circle cutout that together form a needle opening 222. The needle opening 222 provides clearance for the needle so that the sewing guide 216 does not interfere with the sewing needle when the sewing guide 216 is in a fully closed condition. Embroidery material enters the sewing guide 216 at an entrance 218 on one side and exits the sewing guide from an exit 220 on another side. The exit 220 of the sewing guide 216 is open on the bottom so that the sewing guide 216 does not interfere with the embroidery material that is attached to the workpiece after sewing.

Figure 18:
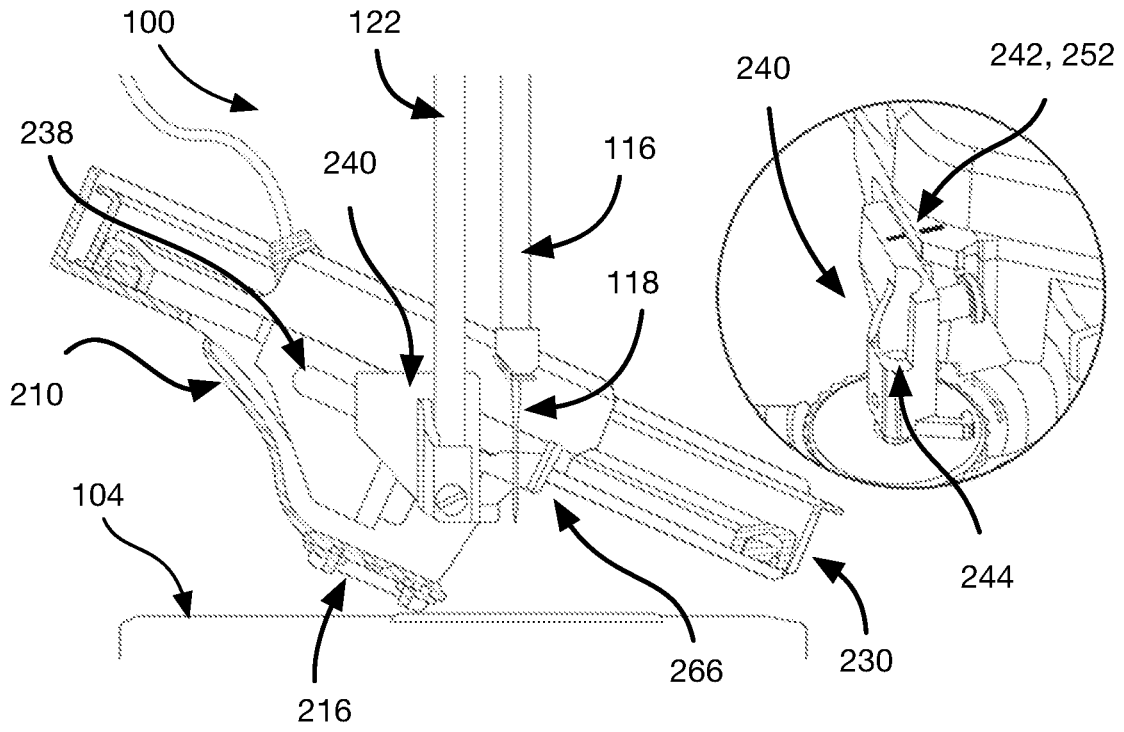
FIG. 18 shows a side cutaway view of an exemplary accessory for a sewing machine being tilted.
Figure 19:
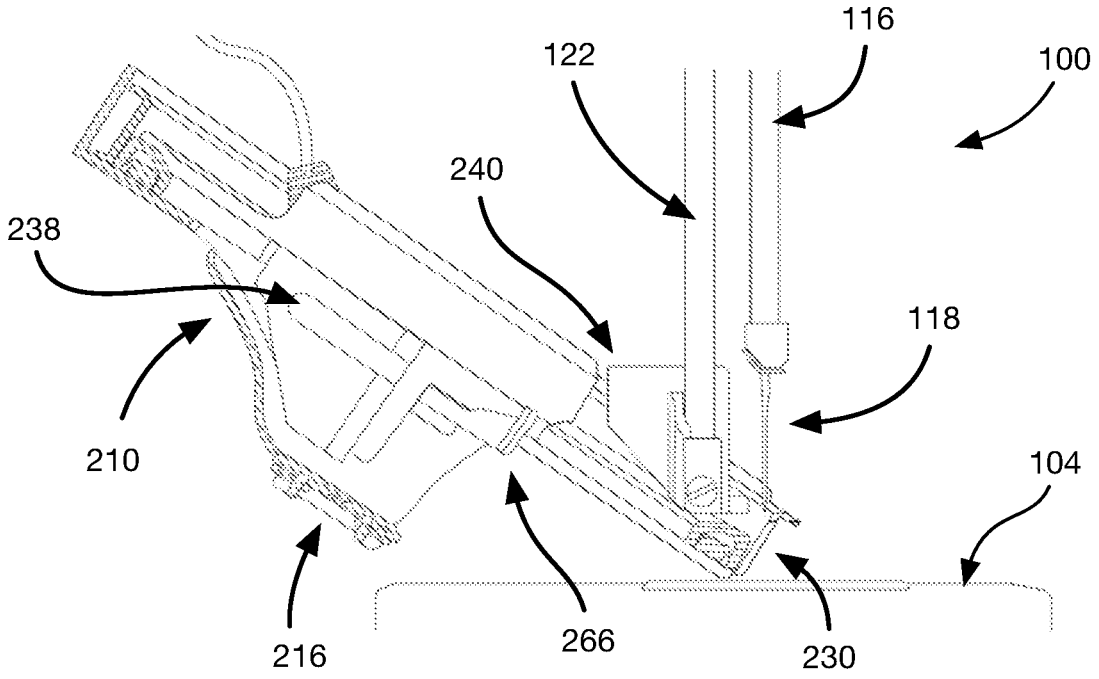
FIG. 19 shows a side cutaway view of an exemplary accessory for a sewing machine being tilted and removed.
Figure 21:
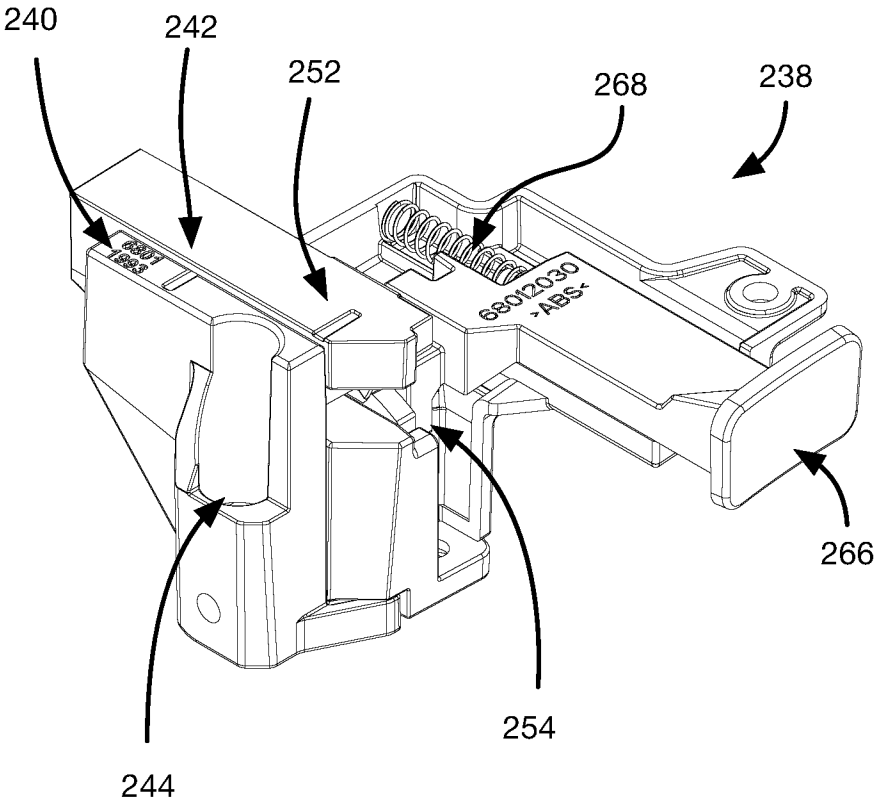
FIG. 21 shows a rear isometric view of the attachment mechanism of FIG. 20.
Figure 20:
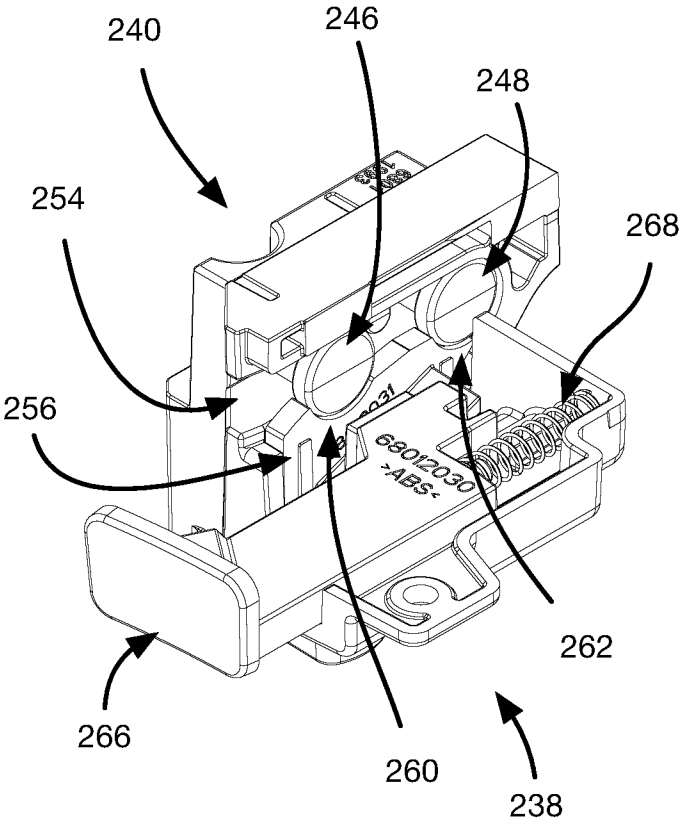
FIG. 20 shows a front isometric view of an attachment mechanism for attaching an exemplary accessory to a sewing machine.
Figure 23:
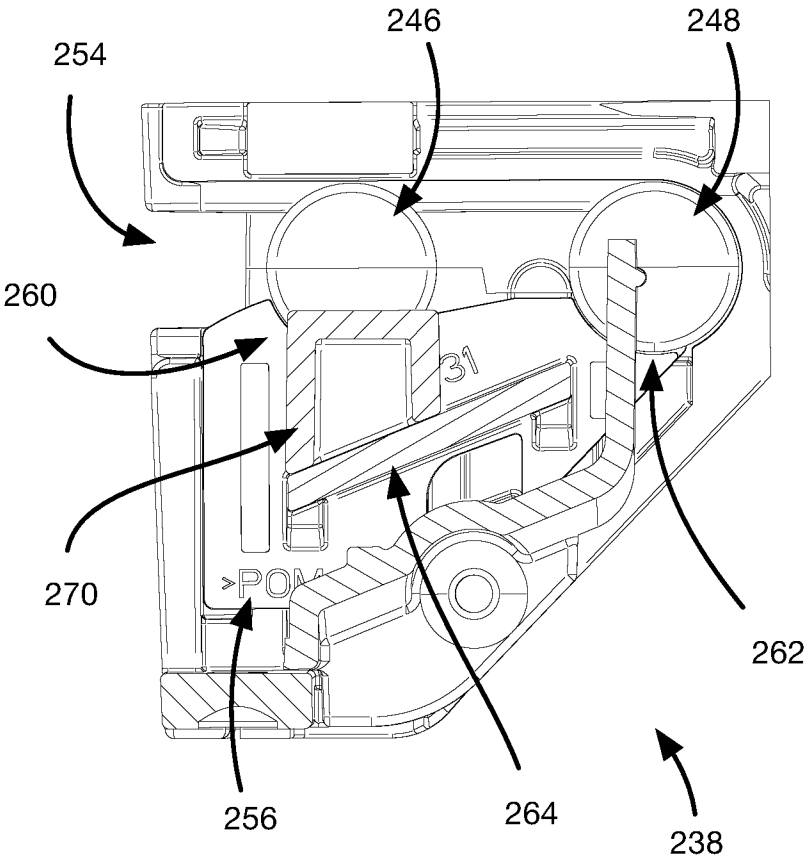
FIG. 23 shows a cross-sectional view of the attachment mechanism of FIG. 20 taken along the line 23-23 in FIG. 22.
Figure 22:
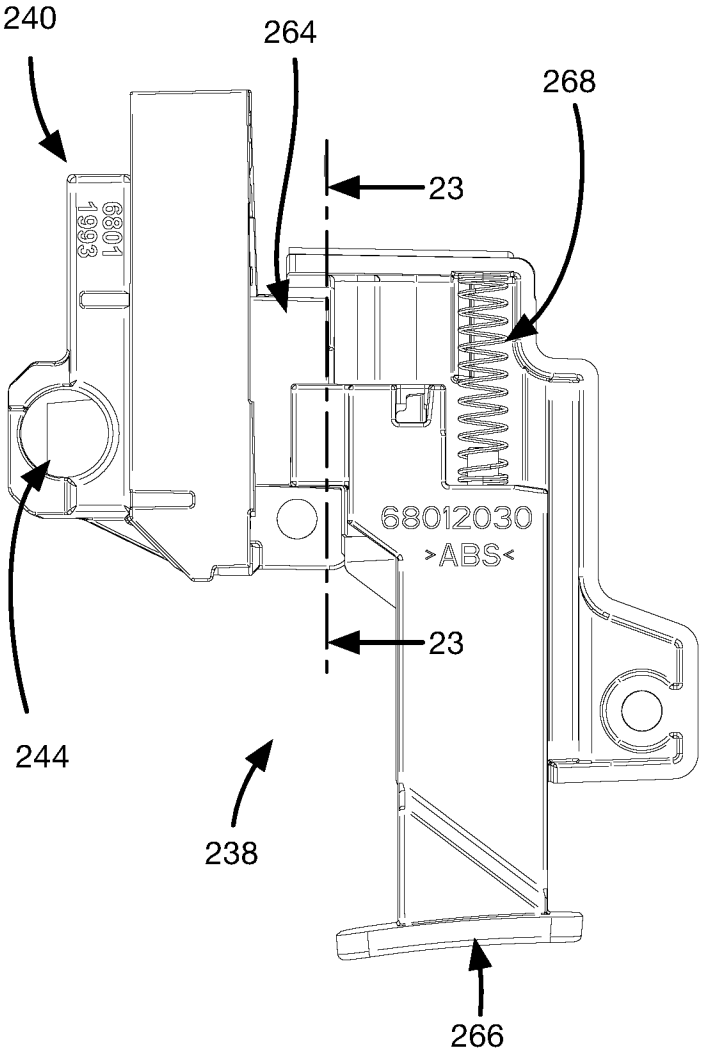
FIG. 22 shows a top view of the attachment mechanism of FIG. 20.
Figure 24:
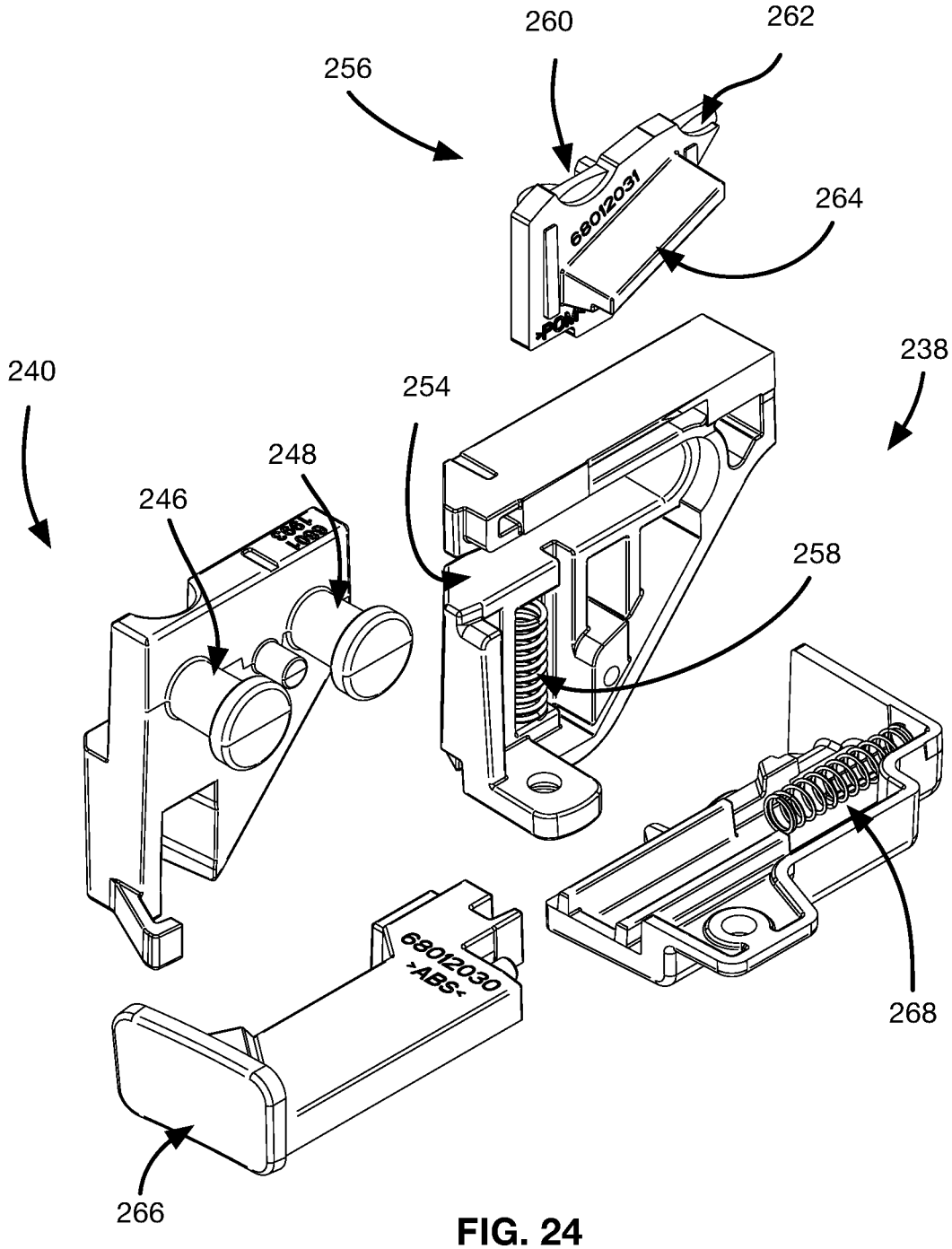
FIG. 24 shows an isometric exploded view of the attachment mechanism of FIG. 20.
Figure 25:
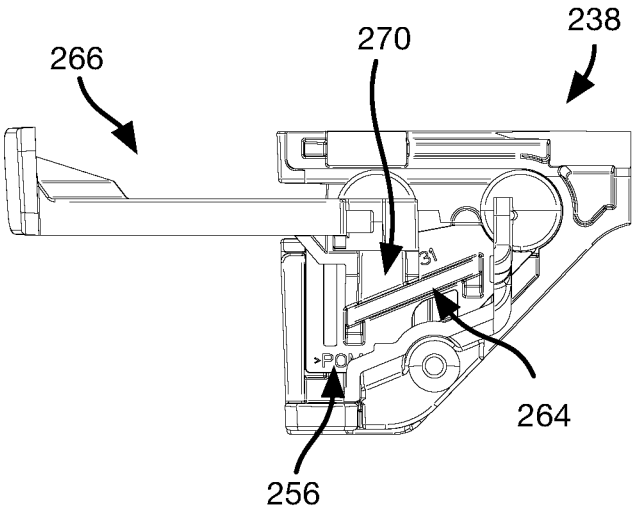
FIGS. 25-34 show views of the attachment mechanism of FIG. 20 being articulated from latched to tilted and to released conditions.
Figure 26:
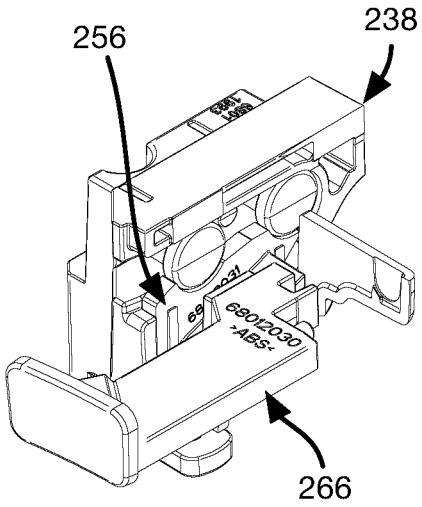

Referring now to FIGS. 18 and 19, partial cutaway views of the accessory 200 are shown in tilted and removed conditions, respectively. The accessory 200 is moved into the tilted condition to enable the user to remove and replace the needle 118 of the sewing machine 100 without fully removing the accessory 200 from the sewing machine 100.

To tilt the accessory 200, the release 266 of the attachment portion 238 is pressed and the accessory 200 is moved rearward until the tilt alignment mark 252 on the attachment portion 238 and the tilt alignment mark 242 on the attachment holder 240 are aligned. The accessory 200 can then be tilted forward to provide access to the needle bar 116 and needle 118. To return the accessory 200 to the installed position, the user tilts the accessory 200 back until the accessory 200 is level and then pulls the accessory 200 forward until the attachment portion 238 clicks back into place.

Removing the accessory 200 from the sewing machine 100 is similar. The release 266 is pressed to disengage the latch 256 of the attachment portion 238 and the accessory 200 is moved backward until the attachment portion 238 is entirely separated from the attachment holder 240 that is attached to the accessory mount 112 of the sewing machine 100. The accessory 200 is then tilted forward so that the front edge of the support 210 and spool 230 can pass beneath the needle 118.

Referring now to FIGS. 20-34, the mechanism that attaches the accessory 200 to the sewing machine 100 and also enables the tilting and removal of the accessory 200 is shown. The attachment portion 238 attaches to the attachment holder 240 and includes the latch 256 and the release 266. The attachment holder 240 includes first and second posts 246, 248 that are received in an attachment interface slot 254 of the attachment portion 238. The latch 256 includes first and second latch recesses 260, 262 for receiving the first and second posts 246, 248. In a fully installed condition, both the first and second posts 246, 248 are secured within the attachment interface slot 254 by the latch 256. In a tilted position, only the second post 248 is secured within the attachment interface slot 254 by the latch 256. Inclined portions of the latch 256 lead up to the first recess 260 and between the first and second recesses 260, 262 to enable the first and second posts 246, 248 to push the latch 256 out of the way when the first and second posts 246, 248 are inserted into the attachment interface slot 254 so that the release 266 does not need to be pressed to attach the accessory 200 to the attachment holder 240.

Figure 27:
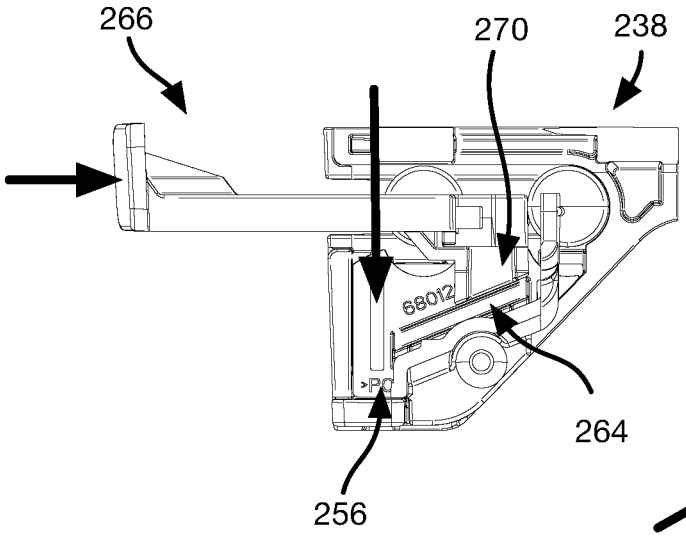
Figure 28:
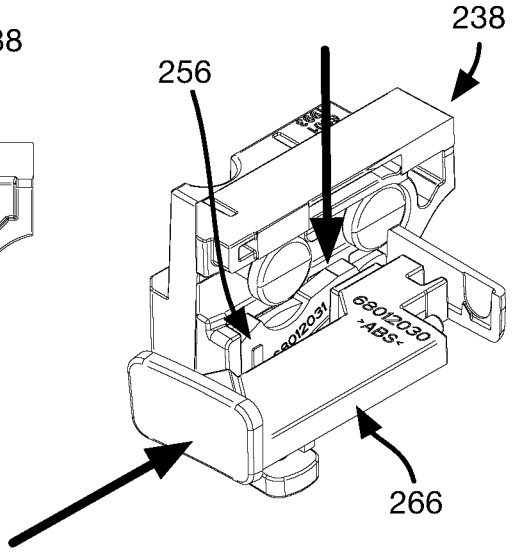
Figure 29:
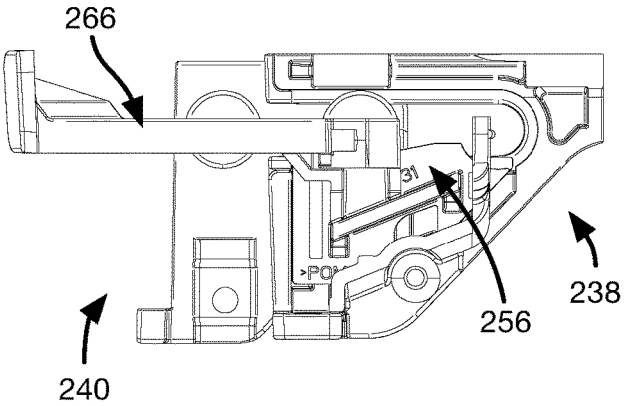
Figure 30:
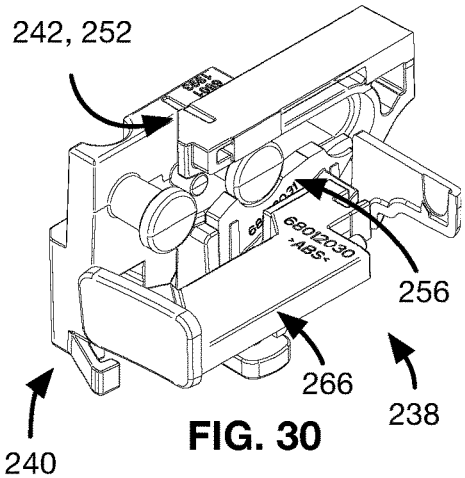
Figure 31:
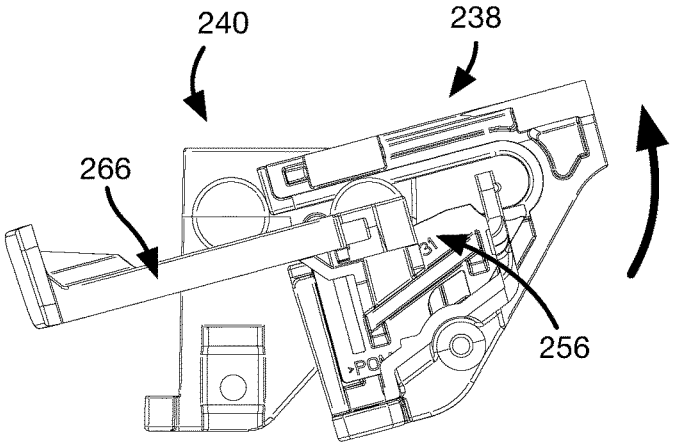
Figure 32:
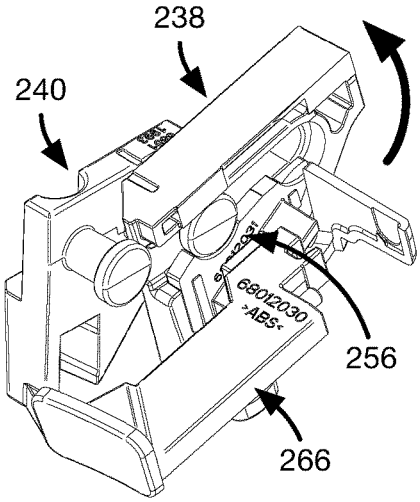
Figure 33:
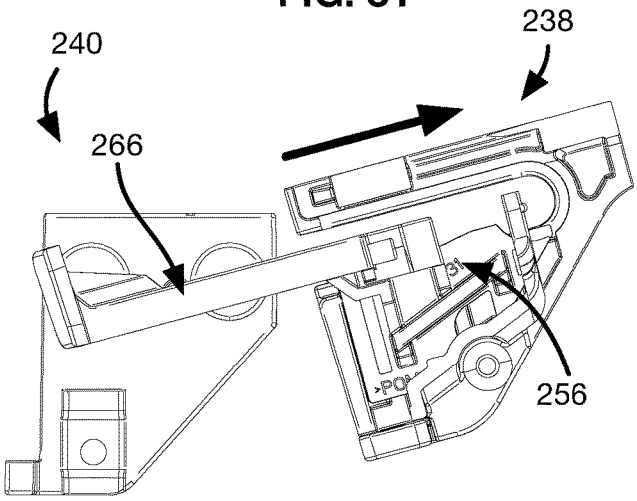
Figure 34:
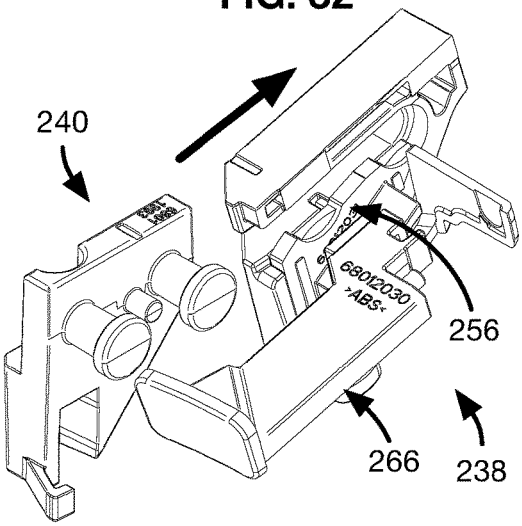

The latch 256 moves vertically within a groove of the attachment portion 238 and is biased toward a closed position by a latch spring 258 that lifts the latch 258 upward toward the attachment interface slot 254. The release 266 is moveable horizontally within a groove of the attachment portion 238 and is biased outward to a disengaged position by a release spring 268. The cross-sectional view of the attachment portion 238 shown in FIG. 23 reveals that the release 266 includes a ramp 270 that engages a ramp 264 of the latch 256 to facilitate opening of the latch 256. Pressing the release 266 inward, as shown in FIGS. 27 and 28, moves the release ramp 270 horizontally against the latch ramp 264, thereby causing the latch 256 to move vertically away from the attachment interface slot 254 and the first and second posts 246, 248 of the attachment holder 240 to release the attachment portion 238 from the attachment holder 240. The accessory 200 can then be moved backward and tilted into the tilted position by pivoting the accessory around the second post 248 (FIGS. 31-32) or fully removed by maintaining the latch 256 in an open position and moving the accessory 200 backward (FIGS. 33-34).

The compact size of the accessory 200 is achieved by arranging the spool 230, support 210, and mechanism 280 for rotating the support 210 in a vertically overlapping manner. For example, the first axis of rotation 204 is parallel to the second axis of rotation 206 and the top surface of the spool 230 is below a top surface of the support 210 and a bottom surface of the spool 230 is above a bottom surface of the support 210. Similarly, the mechanism 280 can be arranged entirely between the top and bottom surfaces of the support 210 or can be positioned so that most or nearly all of the motor of the mechanism 280 is between the top and bottom surfaces of the support 210. Thus, the accessory 200 can be used with a home sewing machine that has an arm height 114 that can be as low as 3 to 6 inches above the sewing bed 104.

During operation of the accessory 200, embroidery material is supplied from the spool 230 that is supported by the support 210. The spool 230 is not fixed to the rotating support 210 so that the spool 230 can rotate freely with respect to the support 210. As embroidery material is dispensed and sewn onto a sewing article (not shown), tension between the embroidery material attached to the cloth workpiece and the embroidery material remaining in the spool 230 causes the spool 230 to rotate in a dispensing direction 231 (FIGS. 3 and 6-7) to dispense more embroidery material for sewing. Because the spool 230 is supported by the support 210, tension forces along the embroidery material are not transmitted to the attachment portion 238 and therefore do not act against or in favor of the rotation of the support 210 nor can these forces push the sewing guide 216 out of alignment with the needle 118.

The sewing machine 100 includes a controller (not shown) that sends signals to the one or more actuators to move the embroidery frame and also that sends signals to the mechanism 280 to control the rotation of the support 210 of the accessory 200 to rotate the support 210 in either a clockwise or counterclockwise direction so that the embroidery material opening 218 of the sewing guide 216 leads the needle opening 222 along the sewing path of the embroidery pattern being sewn by the sewing machine 100. While the support 210 can be rotated in either direction, as indicated by the double ended arrow 211, the spool 230 only rotates in the dispensing direction 231 as embroidery material is dispensed.

An exemplary method of operating an accessory 200 for a sewing machine to attach a length of embroidery material to a workpiece includes the steps of: providing the sewing machine and accessory, moving the workpiece so that the needle of the sewing machine follows a predetermined sewing path, rotating the support so that the embroidery material opening leads the needle along the predetermined sewing path, dispensing at least a portion of the length of embroidery through the embroidery material opening of the guide, and sewing at least a portion of the length of the embroidery material to the workpiece with the needle. The accessory includes a support that can be rotatably attached to the sewing machine, a guide attached to the support, a spool rotatably attached to the support and that is rotatable about a first axis of rotation, and a mechanism that rotates the support about a second axis of rotation. The mechanism can be controlled by the sewing machine. The second axis of rotation is parallel to the first axis of rotation. The guide includes a needle opening for a needle of the sewing machine to pass through and an embroidery material opening spaced apart from the needle opening.

Figure 36:
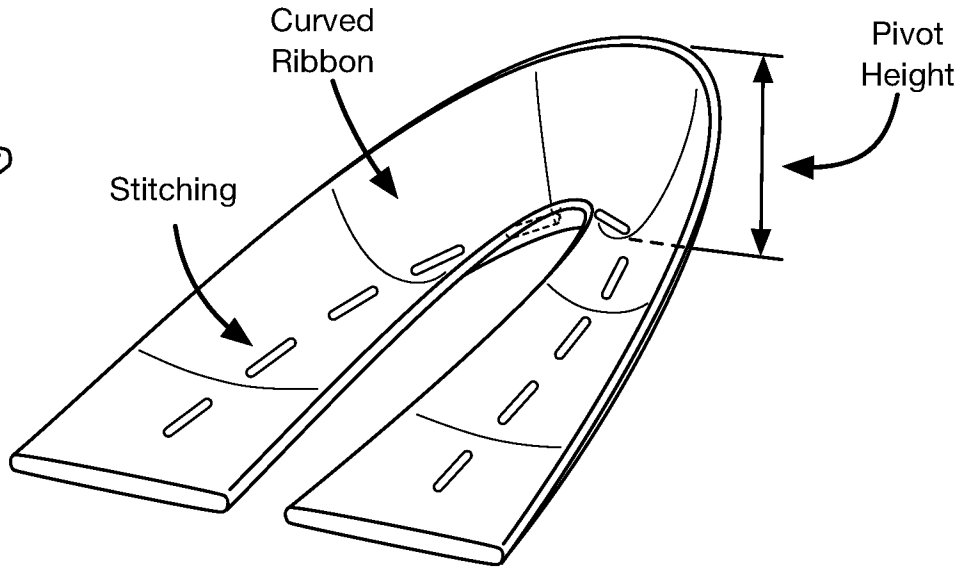
FIGS. 35 and 36 show isometric views of ribbons sewn on straight and curved paths.
Figure 35:
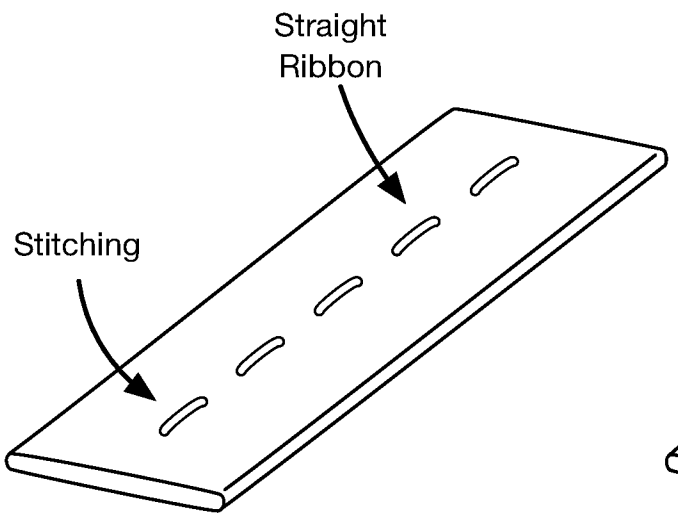
Figure 37:
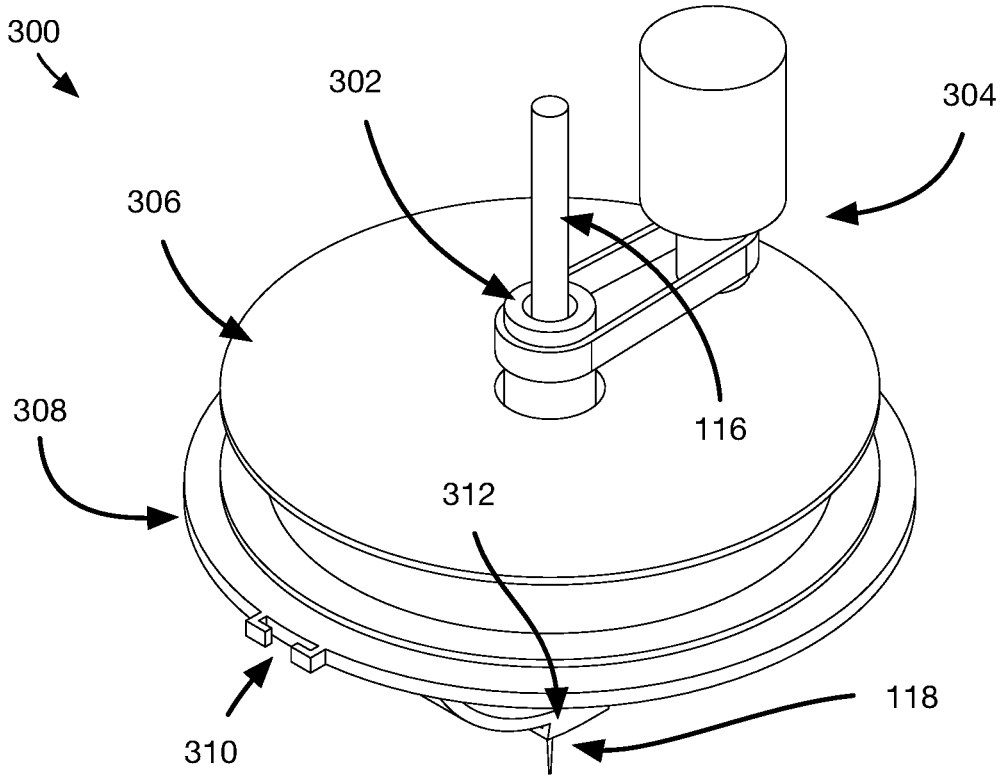
FIG. 37 is a top isometric view of an exemplary embodiment of an accessory for a sewing machine.
Figure 38:
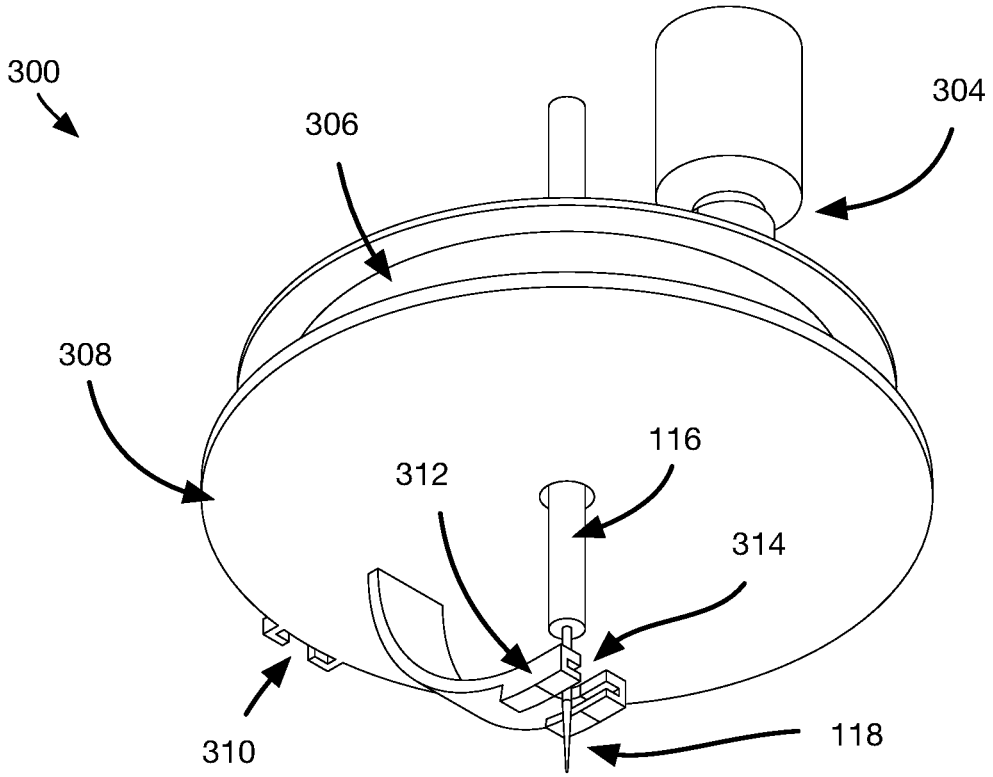
FIG. 38 is a bottom isometric view of the accessory of FIG. 37.
Figure 41:
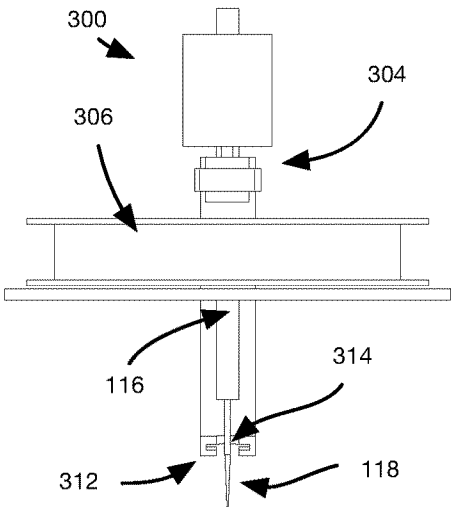
FIG. 41 is a right-side view of the accessory of FIG. 37.
Figure 39:
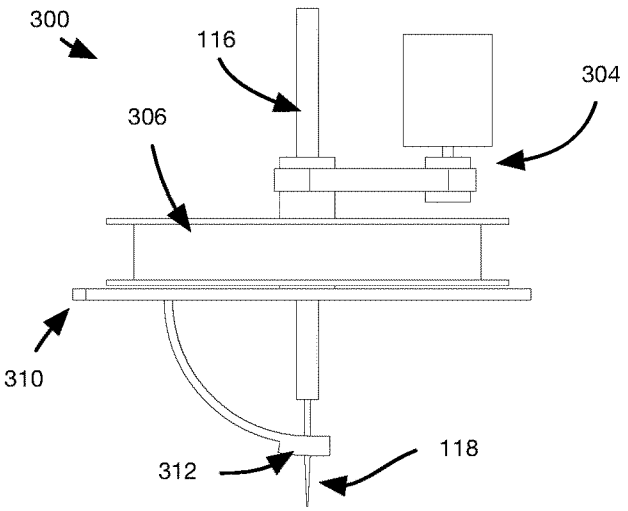
FIG. 39 is a front view of the accessory of FIG. 37.
Figure 40:
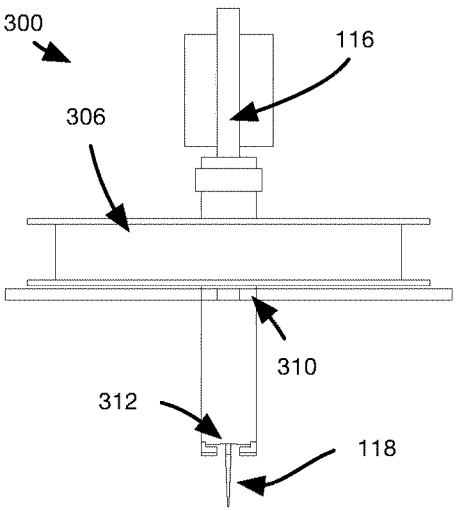
FIG. 40 is a left-side view of the accessory of FIG. 37.
Figure 43:
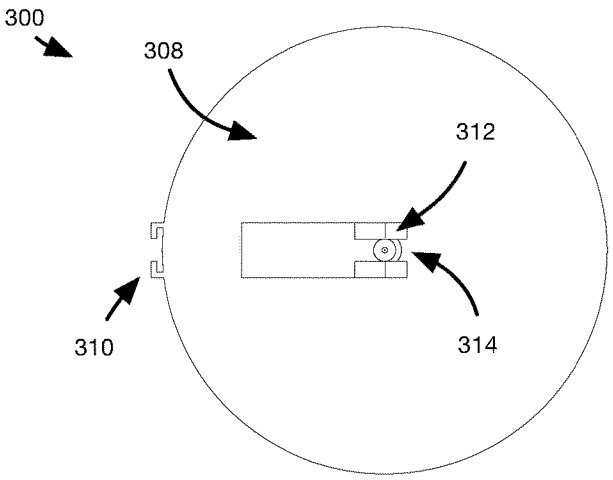
FIG. 43 is a bottom view of the accessory of FIG. 37.
Figure 42:
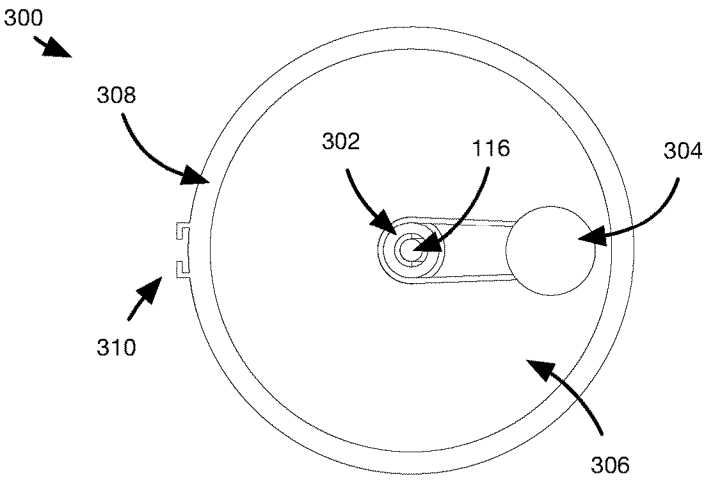
FIG. 42 is a top view of the accessory of FIG. 37.

Referring now to FIGS. 35 and 36, embroidery material—in this case, ribbon—is shown attached to a cloth workpiece along straight and curved paths. When sewn on a straight path, the embroidery material tends to lay flat against the cloth while the embroidery material sewn along the curved path tends to kink or pucker so that the edges of the embroidery material pivot away from the cloth and give the embroidery material a three-dimensional visual effect. The extent of this pivoting can be controlled to produce a wide variety of visual effect by changing the radius of the curved path and the width of the embroidery material. To accommodate various heights of the curved embroidery material, the accessory 200 is spaced apart from the cloth workpiece. In particular, the accessory 200 is spaced apart from the cloth by a pivot height that is greater for wider embroidery materials. The pivot height is set by lowering the accessory 200 to touch the cloth to establish a zero position and then raising the accessory 200 to the desired position. The zero position calibration operation is performed only when the sewing machine is not sewing so that the accessory 200 does not interfere with the movement of the workpiece and embroidery material.

Referring now to FIGS. 37-43, an exemplary accessory 300 for a sewing machine 100 is shown. The accessory 300 is similar in function to the accessory 200 described above and enables dispensing and attachment of an embroidery material to a cloth workpiece during a sewing or embroidery operation. The accessory 300 includes a support 308 that is rotatably attached to the sewing machine (not shown) via an attachment portion 302. The support 308 has a tubular center portion that fits around the needle bar 116 of the sewing machine so that the support 308 rotates around the needle bar 116 during operation. The support 308 is rotated by a rotation mechanism 304 that includes a belt or gear or other suitable means for rotating the support 308 relative to the sewing machine. A spool 306 rests on and rotates relative to the support 308. In some embodiments the rotation mechanism 304 is attached to and rotates with the support and can be arranged above, below, or within a central opening of the spool 306. Embroidery material is drawn from the spool 306, through a dispensing guide 310 and a sewing guide 312 that are each attached to the support 308. The sewing guide 312 includes a needle opening 314 so that the needle 118 can attach the embroidery material to the workpiece.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein.

Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. An accessory for a sewing machine, the accessory comprising:

a spool that is rotatable about a first vertical axis of rotation, wherein the spool receives and dispenses a length of embroidery material;

a support rotatably attached to the sewing machine and to the spool, wherein a plurality of locations on a downward-facing surface of the spool are supported above a sewing bed of the sewing machine by the support;

a sewing guide having a needle opening configured to receive a needle of the sewing machine and to guide the embroidery material toward the needle; and a mechanism that rotates the support around a second vertical axis of rotation.

2. The accessory of claim 1, wherein the second vertical axis of rotation is colinear with a longitudinal axis of the needle.

3. The accessory of claim 1, wherein the spool and the support rotate independently around the first vertical axis of rotation.

4. The accessory of claim 1, wherein the mechanism rotates the support clockwise and counterclockwise about the second vertical axis of rotation.

5. The accessory of claim 1, further comprising an attachment portion attached to the support, wherein the attachment portion comprises an opening for receiving a presser bar of a sewing machine, and wherein the opening is offset from at least one of the first vertical axis of rotation and the second vertical axis of rotation.

6. The accessory of claim 5, wherein the mechanism comprises:

a motor mounted on the attachment portion;

a ring gear attached to the support; and a transmission that transmits rotary motion of the motor to the ring gear of the support.

7. The accessory of claim 6, wherein at least a portion of the motor is arranged between a top surface and a bottom surface of the spool.

8. The accessory of claim 1, wherein at least a portion of the support has a cone shape extending from a first end to a second end, wherein the first end is wider than the second end, wherein the first end is disposed above the second end, and wherein the spool is attached to the support at the first end of the support.

9. The accessory of claim 1, wherein a vertical height of the accessory between a bottom surface of the sewing guide and a top surface of the spool is not more than 3 inches.

10. The accessory of claim 1, wherein an inner diameter of the spool is not less than 6.5 inches.

11. The accessory of claim 1, wherein the support further comprises a dispensing guide, the dispensing guide comprising a guide surface arranged at about 45 degrees to the first vertical axis of rotation.

12. The accessory of claim 1, wherein an outer surface of the length of embroidery material when the length of embroidery material is arranged on the spool becomes a top surface of the length of embroidery material when the length of embroidery material is sewn onto a workpiece.

13. The accessory of claim 1, wherein the downward-facing surface is a bottom surface of the spool.

14. A sewing machine for attaching a length of embroidery material to a workpiece, the sewing machine comprising:

a bed;

an actuatable embroidery frame mount configured to receive an embroidery frame for holding the workpiece;

an arm disposed above the bed, wherein a bottom surface of the arm is spaced apart from a top surface of the bed by an arm height; and an accessory for dispensing the length of embroidery material to be sewn to the workpiece, the accessory comprising:

a spool that is rotatable about a first vertical axis of rotation, wherein the spool receives and dispenses the length of embroidery material;

a support rotatably attached to the arm and to the spool, wherein the spool is supported above the bed of the sewing machine by the support;

a sewing guide having a needle opening configured to receive a needle of the sewing machine and to guide the embroidery material toward the needle;

an attachment portion that attaches the accessory to a presser bar of the sewing machine, wherein the support is attached to the attachment portion and the attachment portion is attached to the presser bar in place of a presser foot, and wherein the presser bar is offset from at least one of the first vertical axis of rotation and a second vertical axis of rotation; and a mechanism that rotates the support around the second vertical axis of rotation, wherein the second vertical axis of rotation is colinear with the first vertical axis of rotation.

15. The sewing machine of claim 14, wherein the spool and the support rotate independently around the first vertical axis of rotation.

16. The sewing machine of claim 14, wherein the mechanism rotates the support clockwise and counterclockwise around the second vertical axis of rotation.

17. The sewing machine of claim 14, wherein a plurality of locations on a downward-facing surface of the spool are supported above a sewing bed of the sewing machine by the support.

18. The sewing machine of claim 17, wherein the mechanism comprises:

a motor mounted on the attachment portion, wherein at least a portion of the motor is arranged between a top surface and a bottom surface of the spool;

a ring gear attached to the support; and a transmission that transmits rotary motion of the motor to the ring gear of the support.

19. The sewing machine of claim 17, wherein the downward-facing surface is a bottom surface of the spool.

20. A method of operating an accessory for a sewing machine to attach a length of embroidery material to a workpiece, the method comprising:

providing the sewing machine and accessory, the accessory comprising:

a spool that is rotatable around a first vertical axis of rotation, wherein the spool receives and dispenses a length of embroidery material;

a support rotatably attached to the sewing machine and to the spool, wherein a plurality of locations on a downward-facing surface of the spool are supported above a sewing bed of the sewing machine by the support so that the spool and the support rotate independently around the first vertical axis of rotation;

a sewing guide having a needle opening configured to receive a needle of the sewing machine and to guide the embroidery material toward the needle;

a mechanism that rotates the support clockwise and counterclockwise around a second vertical axis of rotation and an attachment portion that attaches the accessory to a presser bar of the sewing machine, wherein the support is attached to the attachment portion and the attachment portion is attached to the presser bar in place of a presser foot, and wherein the presser bar is offset from at least one of the first vertical axis of rotation and the second vertical axis of rotation:

moving the workpiece so that the needle of the sewing machine follows a predetermined sewing path;

operating the mechanism to rotate the support clockwise or counterclockwise so that the embroidery material leads the needle along the predetermined sewing path;

dispensing at least a portion of the length of embroidery through the sewing guide; and sewing at least a portion of the length of the embroidery material to the workpiece with the needle.

21. The method of claim 20, wherein moving the workpiece causes dispensing of the length of embroidery material.

22. The method of claim 20, wherein the first and second vertical axes of rotation are colinear.

* * * * *